US007722138B2

(12) United States Patent
Jackson et al.

(10) Patent No.: US 7,722,138 B2
(45) Date of Patent: May 25, 2010

(54) STORAGE CABINET

(75) Inventors: Jeremy J. Jackson, Big Rapids, MI (US); Cory S. Erickson, Big Rapids, MI (US); Terry A. Butcher, Holland, MI (US); Jayson J. Robinson, Stanwood, MI (US)

(73) Assignee: Haworth, Inc., Holland, MI (US)

( * ) Notice: Subject to any disclaimer, the term of this patent is extended or adjusted under 35 U.S.C. 154(b) by 128 days.

(21) Appl. No.: 11/147,402

(22) Filed: Jun. 7, 2005

(65) Prior Publication Data

US 2005/0280337 A1 Dec. 22, 2005

Related U.S. Application Data

(63) Continuation-in-part of application No. 11/049,199, filed on Feb. 2, 2005, now abandoned, which is a continuation-in-part of application No. 10/867,564, filed on Jun. 14, 2004, now abandoned.

(60) Provisional application No. 60/478,590, filed on Jun. 13, 2003.

(51) Int. Cl.
*A47B 43/00* (2006.01)
*A47B 47/00* (2006.01)

(52) U.S. Cl. ..... 312/257.1; 312/264

(58) Field of Classification Search ..... 312/257.1, 312/263, 264, 330.1, 400, 409
See application file for complete search history.

(56) References Cited

U.S. PATENT DOCUMENTS 1,352,002 A 9/1920 Jones
1,833,882 A * 11/1931 Attwood ..... 312/323
3,095,838 A * 7/1963 Paulos et al. ..... 109/80
3,622,216 A * 11/1971 Haunost ..... 312/219
3,623,784 A 11/1971 Neufeld
3,779,623 A 12/1973 Motohashi
3,833,279 A 9/1974 MacKenzie, Jr.
4,303,286 A * 12/1981 McClellan ..... 312/409
4,692,984 A 9/1987 McKernan et al.
5,172,967 A 12/1992 Pipe
5,249,857 A 10/1993 Suzuki
5,364,178 A * 11/1994 Hofman et al. ..... 312/263
5,378,057 A 1/1995 Bach et al.
5,433,156 A 7/1995 Hutchison
5,536,079 A 7/1996 Kostic
5,997,114 A 12/1999 Bischoff
6,142,591 A 11/2000 Hemann
6,217,139 B1 4/2001 Henriott
6,238,024 B1 5/2001 Sawatzky

* cited by examiner

*Primary Examiner*—Janet M Wilkens
*Assistant Examiner*—Timothy M Ayres
(74) *Attorney, Agent, or Firm*—Flynn, Thiel, Boutell & Tanis, P.C.

(57) ABSTRACT

A file cabinet includes a foldable sheet metal housing wrapper or individual side panels which define a back wall and the left and right side walls of the cabinet. A reinforcement box or insert is permanently affixed within the back of the cabinet which reinforcement box is spaced forwardly of the back wall to define a strengthening column which rigidifies the overall housing structure. Upper and lower cross rails are secured to the upper and lower corners of the side walls at the front of the cabinet to rigidify the front of the cabinet. The opposite ends of the cross rail have depending flanges which are fixedly secured to vertical tubular edge supports formed integrally in the side walls.

31 Claims, 30 Drawing Sheets

FIG. 13
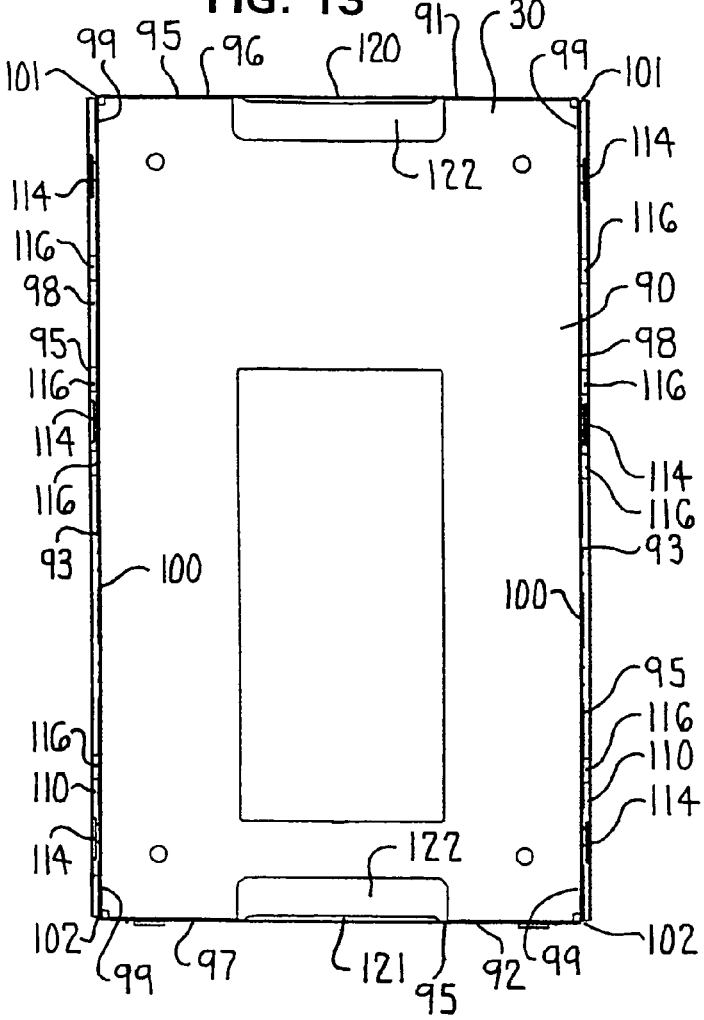
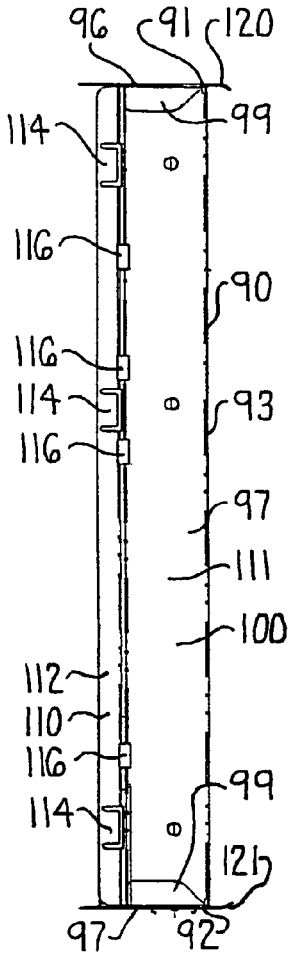
FIG. 15
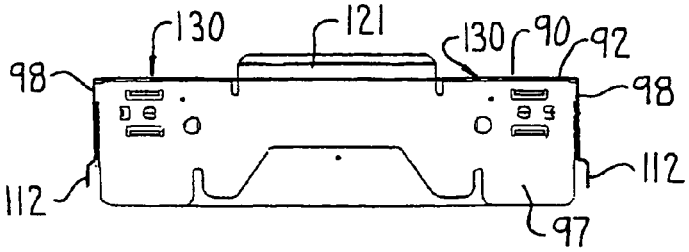
FIG. 14

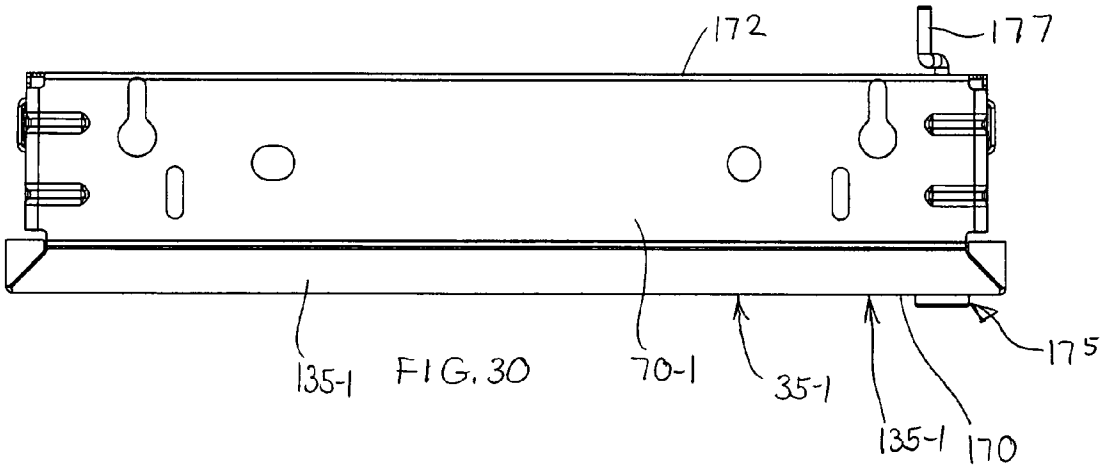
FIG. 30
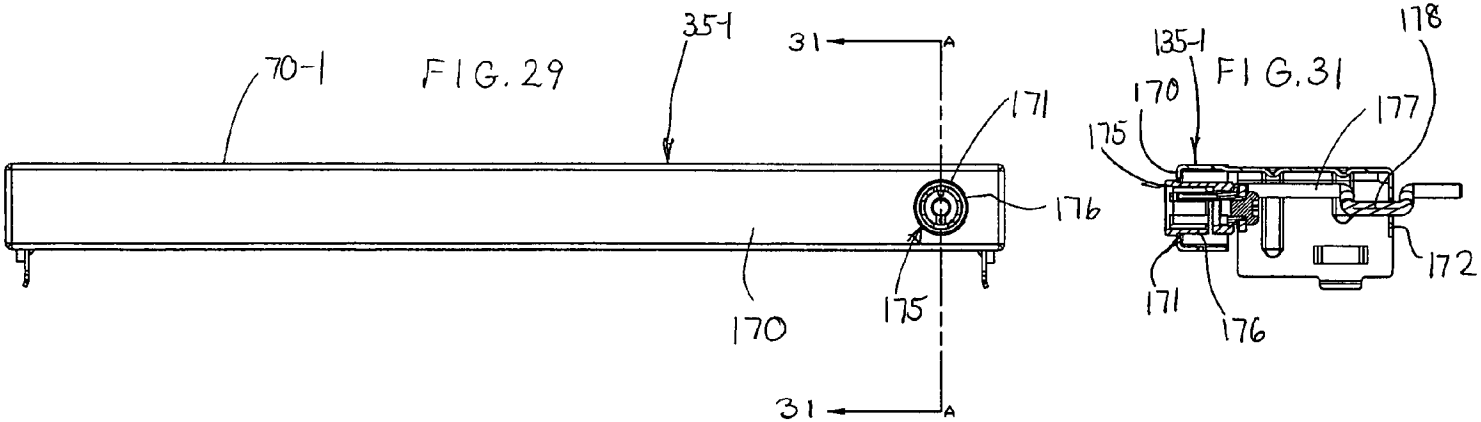
FIG. 29
FIG. 31

300
292
293
302
291
234
290
235
294
291
203
219

271
218
262
303
263
304
270
274
264
220
213
300
254
253
274
252
201
200
301
270
71
216
215

292
300
302
234
235
294
293
219
263
228
213
232
320
321
282
323
283
322
219
230
217
312
300
311
282
293
310
225
313
226
202

STORAGE CABINET

CROSS REFERENCE TO RELATED APPLICATIONS

This application is a continuation-in-part of U.S. application Ser. No. 11/049,199, filed Feb. 2, 2005 now abandoned, which is a continuation-in-part of U.S. application Ser. No. 10/867,564, filed Jun. 14, 2004 now abandoned, which claims priority of U.S. Provisional Application Ser. No. 60/478,590, filed Jun. 13, 2003.

FIELD OF THE INVENTION

The invention relates to a storage cabinet, and more particularly, to a storage cabinet having a housing defined by a foldable wrapper or individual side panels, which define multiple sides of the storage cabinet, and an internal framework providing rigidity to the housing.

BACKGROUND OF THE INVENTION

Storage cabinets such as those used in offices for storage of files and the like conventionally have an exterior housing which has a box-shape that is open on a front side. The housing has at least three side walls and a top wall wherein an open side is adapted to receive a plurality of drawers therein.

One conventional housing construction has a foldable sheet of wall material that defines a plurality and typically three of the vertical walls of the cabinet. More particularly, this foldable material sheet is commonly referred to as the housing wrapper wherein the left and right side walls as well as the back wall are formed together as a single piece, but each wall is separated one from the other by a fold line. The wrapper is folded into a box-like configuration to define the side walls and back wall wherein a separate top wall typically is mounted directly on the walls and then suitable drawers are fitted into the open front defined by the housing wrapper.

Since such housing wrapper is formed of sheet metal and therefore does not have significant lateral rigidity, additional internal frame pieces are mounted on the side walls to maintain the side walls and back wall in a rigid box-like shape. For example, each side wall may include a front vertical rail and a rear vertical rail which are affixed to the inside face of the side wall wherein additional horizontal cross rails extend between the upper ends of each pair of front vertical rails and the rear vertical rails while additional lower cross rails are mounted to the respective lower ends of the front and rear vertical rails. As such, near the front and rear ends of each side wall, the various rails are joined end-to-end into a rectangular configuration to increase the lateral and vertical strength of the overall cabinet structure formed by the wrapper. Additionally, the vertical side rails are adapted to support drawer slides thereon which drawer slides in turn support slidable drawers that are movable inwardly and outwardly from the open front side of the cabinet.

While such internal frame rails serve to rigidify the overall wrapper structure, the frame rails still are able to deflect, particularly at the upper and lower corners thereof, to permit undesirable lateral deflection, i.e. racking, of the cabinet. To determine the relative strength of a cabinet construction, it is known to measure the extent of force placed laterally on an upper corner of the cabinet, which force will cause lateral deflection or racking of one inch.

It is an object of the invention to provide an improved cabinet construction which is stronger so as to provide better resistance to lateral deflection of the cabinet while also simplifying the arrangement of component parts and the assembly thereof.

The invention relates to a storage cabinet and in particular, a file cabinet having an external housing adapted to support a plurality of storage drawers therein. The cabinet of the invention in one embodiment uses a foldable housing wrapper which defines the side walls and back wall of the cabinet in a manner similar to prior art cabinets. In another embodiment, the side and back walls are separate pieces joined by screws. The inventive cabinet further includes a reinforcement box or insert which fits, preferably, into the back end portion of the hollow interior of the housing and in the case of the wrapper, after the wrapper is folded to define the side walls and back wall.

The reinforcement box generally has five sides defined by a vertical back panel which is disposed in opposing relation with the back wall of the cabinet housing. The back panel of the insert further includes four side panels which project forwardly of the back panel from the periphery thereof. Each of the side panels are rigidly joined together at their upper and lower corners to define a rigid open-sided box structure. The back panel has a rectangular shape and is integrally joined together with the side panels along the periphery thereof such that the back panel maintains the side panels in a rectangular configuration and resists deflection of the side panels, particularly at the corners.

An opposite pair of the box side panels extend vertically and are disposed in facing relation with the interior surfaces of the cabinet side walls. These vertical panels are rigidly affixed to the cabinet side walls, preferably by welding. The side panels of the reinforcement box therefore rigidify the overall cabinet structure in that the back panel reinforces the box side panels and greatly increases the overall resistance of the cabinet to lateral deflections.

Additionally, the reinforcement box has the back panel spaced forwardly of the back wall of the cabinet housing to thereby define a vertical channel therebetween. This spacing effectively results in a hollow column being formed by the cabinet back wall, the insert back panel and the rearmost edge portions of the cabinet side walls. The overall rigidity of the cabinet housing thereby is further increased.

Other objects and purposes of the invention, and variations thereof, will be apparent upon reading the following specification and inspecting the accompanying drawings.

BRIEF DESCRIPTION OF THE DRAWINGS

FIG. 13 is a front elevational view of the reinforcement box or insert.

FIG. 14 is a bottom view of the reinforcement box.

FIG. 15 is a side elevational view of the reinforcement box.

FIG. 29 is a front elevational view of the top cross rail with a lock assembly supported therein.

FIG. 30 is a plan view of the top cross rail with the lock assembly.

FIG. 31 is a side cross sectional view of the top cross rail and lock assembly as taken along line 31-31 of FIG. 29.

Figure 1:
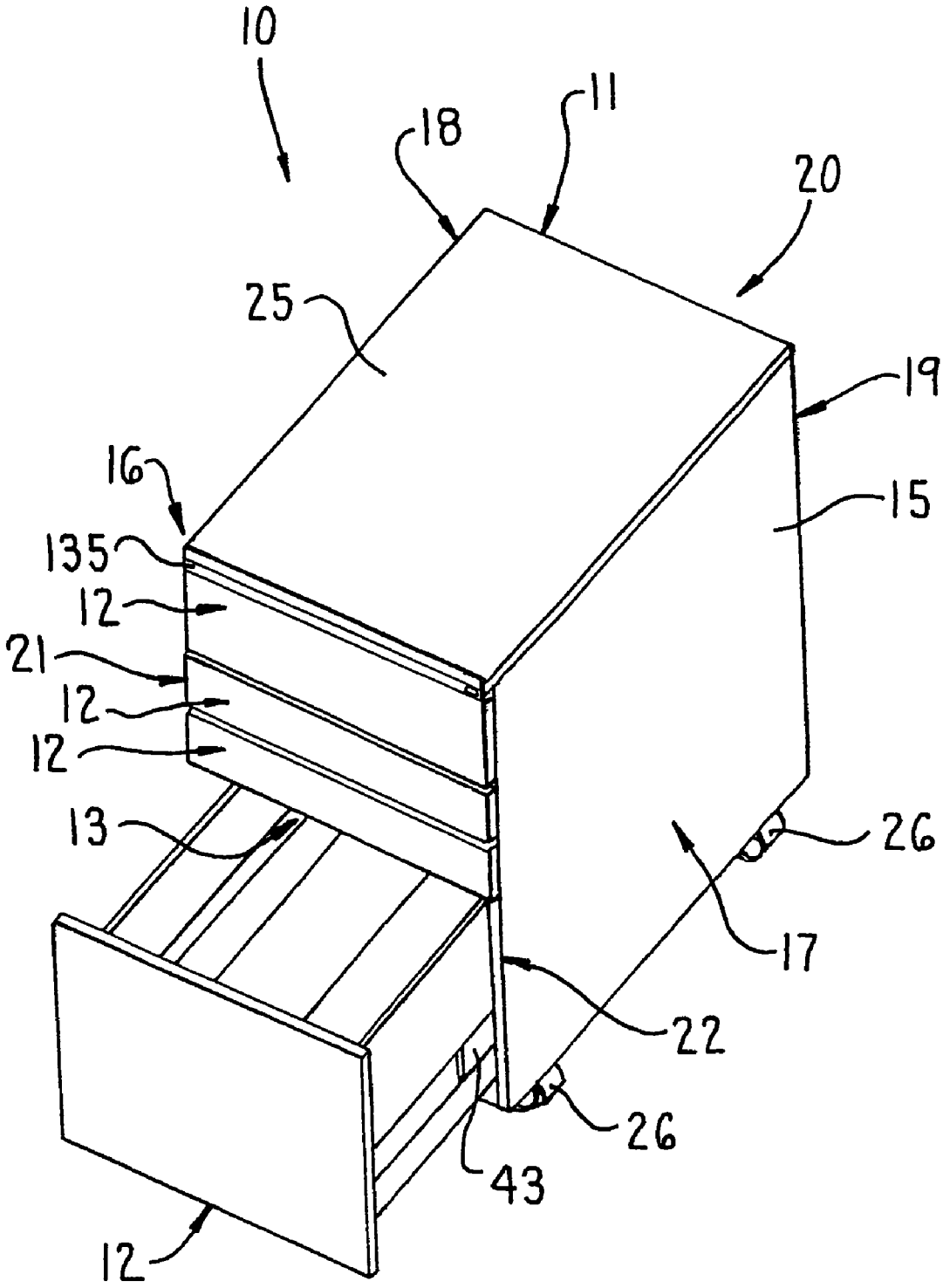
FIG. 1 is a perspective view of a file cabinet of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
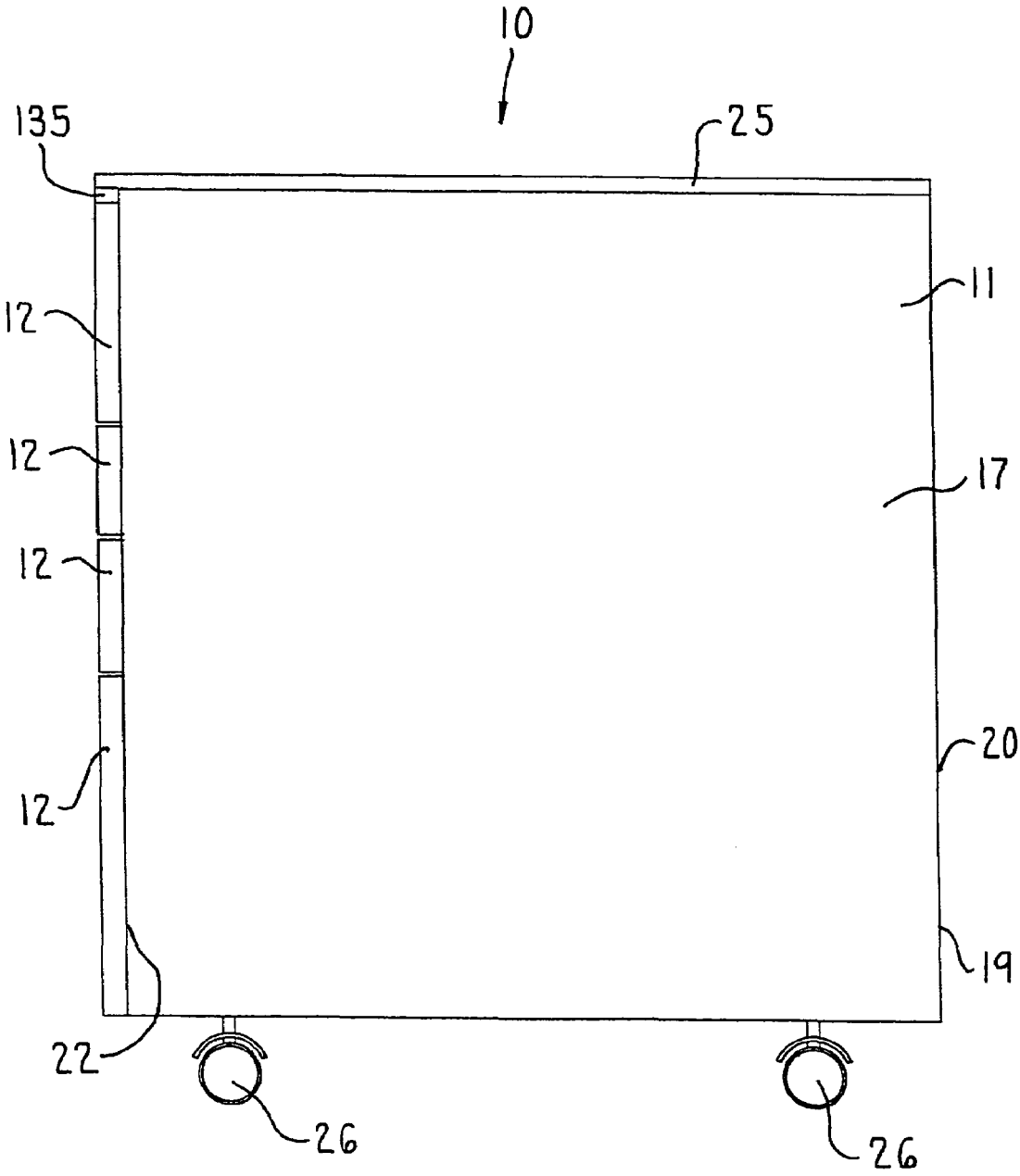
FIG. 2 is a side elevational view of the file cabinet.

Referring to FIGS. 1 and 2, a first embodiment of the invention relates to a storage cabinet 10 which is formed as a file cabinet that is adapted to store files and other office supplies therein. The storage cabinet 10 is a first embodiment of the invention that generally includes a cabinet housing 11 which is adapted to receive a plurality of drawers 12 through an open front side 13 thereof. The drawers 12 are slidable to a stored or closed position enclosed entirely within the housing 11 and are openable to an extended or open position as generally seen in FIG. 1.

The cabinet housing 11 in the first embodiment includes a housing wrapper 15 which is formed as a one-piece unit of sheet metal material and is foldable to define left and right side walls 16 and 17 having rear edge or corner portions 18 and 19 which side walls 16 and 17 are joined together by a back wall 20. The housing wrapper 15 thereby defines three sides of the cabinet 11. When folded into the configuration of FIG. 3, the wrapper 15 is open on the top and bottom and has front edge portions 21 and 22 of the side walls 16 and 17 respectively which are laterally spaced apart to define the open front side 13.

Figure 3:
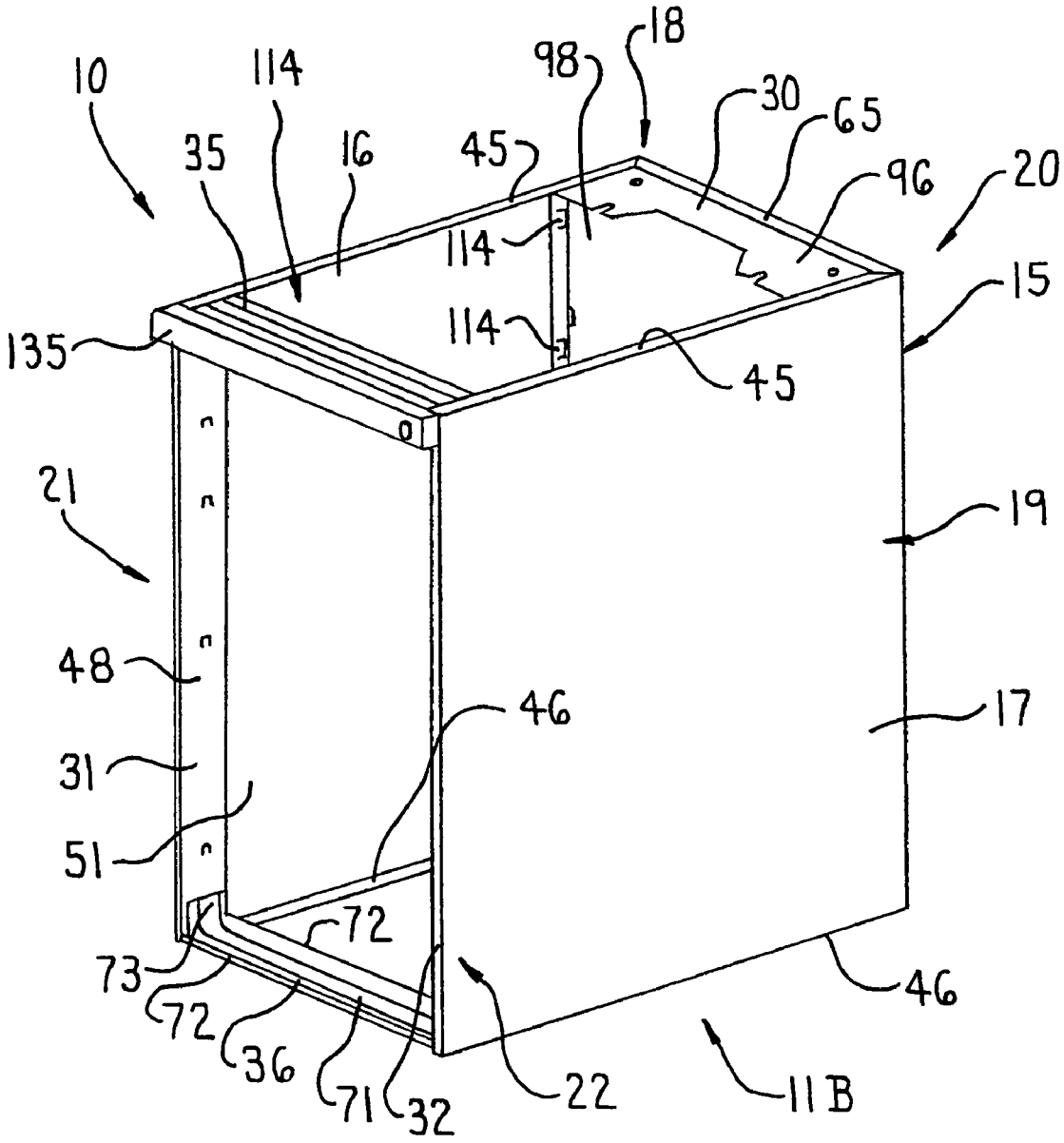
FIG. 3 is a perspective view of the cabinet housing with a top wall and the drawer removed therefrom.

The cabinet housing 11 ultimately is enclosed on the top side 11A thereof by a top wall 25 and has a bottom side 11B that is supported on a plurality of casters 26. As generally illustrated in FIGS. 2 and 3, the housing wrapper 15 is strengthened or rigidified by a reinforcement box or insert 30 which is rigidly fixed in position within the back area of the housing wrapper 15 proximate the back wall 20.

Figure 4:
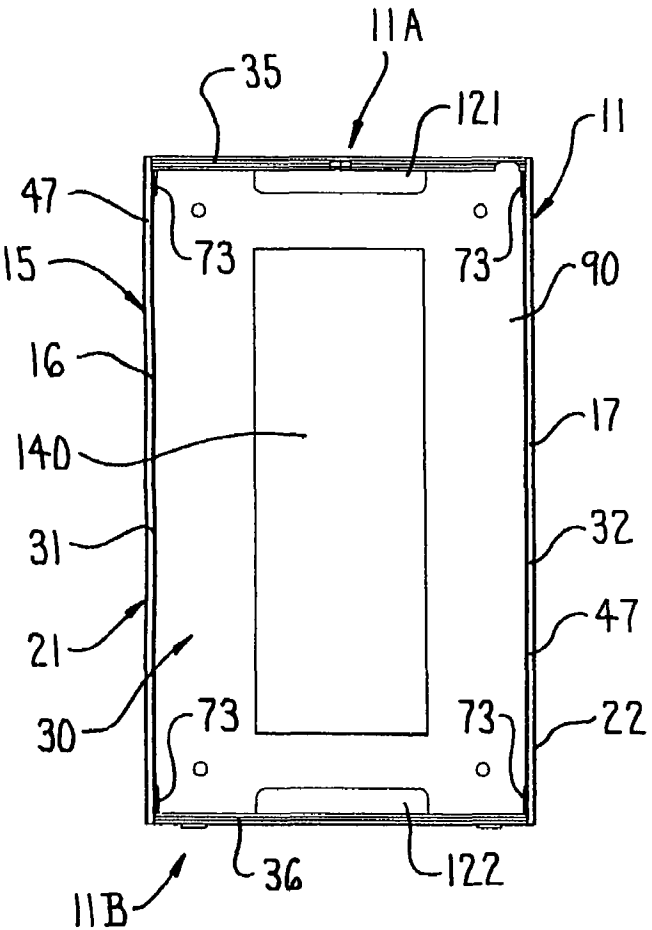
FIG. 4 is a front elevational view of the cabinet housing.

To rigidify the front of the housing wrapper 15, the side walls 16 and 17 further include vertical and tubular reinforcement edge supports 31 and 32 at the front edge portions 21 and 22 respectively of the side walls 16 and 17. The reinforcement edge supports 31 and 32 are formed integral with the side walls 16 and 17 by folding the sheet metal material housing wrapper 15 inwardly and rearwardly into a tubular shape. Additionally as seen in FIGS. 3 and 4, an upper cross rail 35 and a lower cross rail 36 are joined to the respective upper and lower ends of the reinforcement rails 31 and 32 to thereby rigidify the front of the cabinet wrapper 15.

Figure 5:
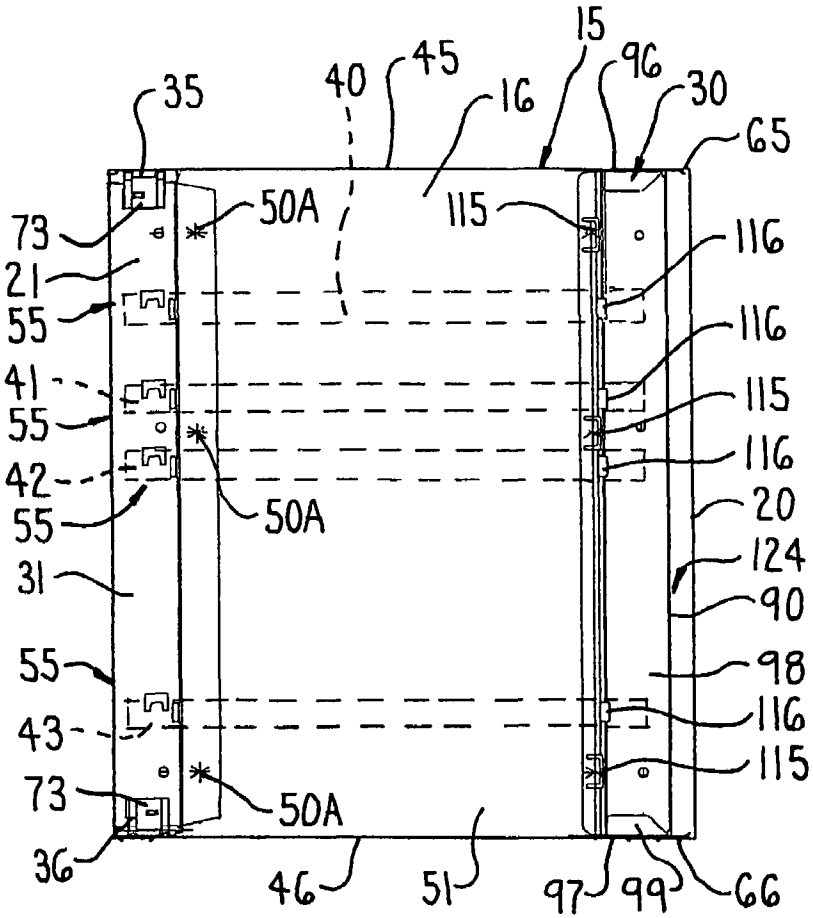
FIG. 5 is a right side elevational view illustrating the interior of the left side wall of the cabinet housing with drawer slides diagrammatically illustrated in phantom outline.

The cabinet housing 11 further includes a plurality of conventional drawer slides on both of the side walls 16 and 17 as illustrated diagrammatically in FIG. 5. The drawer slides are illustrated in phantom outline and identified from top to bottom by reference numerals 40, 41, 42 and 43. The drawer slides 4043 are adapted to support side walls of the individual drawers 12 as generally illustrated in FIG. 1 and are extendable to allow pulling of the drawers to the extended position. Such drawer slides 40-43 have a conventional construction and are well known in the art such that a detailed discussion of the drawer slides 40-43, their mounting to the side walls 16 and 17, and their support of the drawers 12 is not required.

More particularly, as to the housing wrapper 15, the housing wrapper 15 is formed of three contiguous sections which define the side walls 16 and 17 and the back wall 20. The housing wrapper 15 is formed from a planar sheet of housing material which is preferably sheet metal that is painted on one side to provide a finished aesthetic appearance for the cabinet 10. The housing wrapper 15 is formed as a flat sheet and then is bent about fold lines to define the corners 18 and 19 which join the back wall 20 to the side walls 16 and 17. When bent, the side walls 16 and 17 and back wall 20 are oriented vertically and define the three sides of the storage cabinet 10 as seen in FIGS. 3 and 4. Such a housing wrapper 15, however, has significant flexure and is readily deflectable and thus, requires additional frame structure to rigidify the storage cabinet 10.

Figure 7:
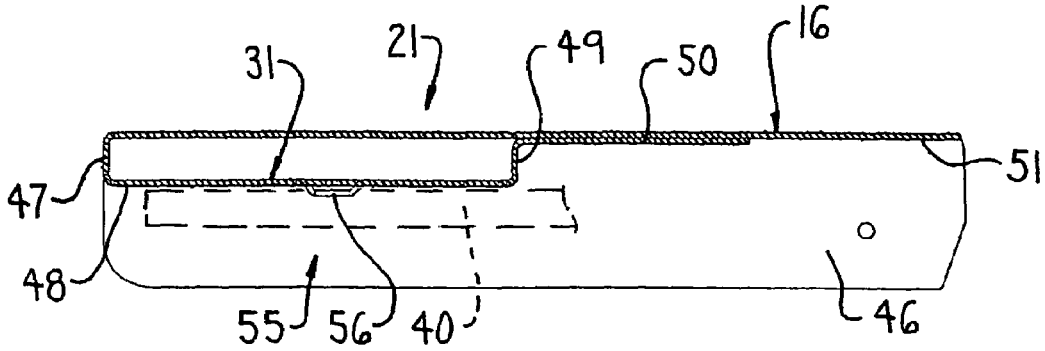
FIG. 7 is an enlarged plan view of the front edge of the left side wall with a drawer slide illustrated in phantom outline.
Figure 6:
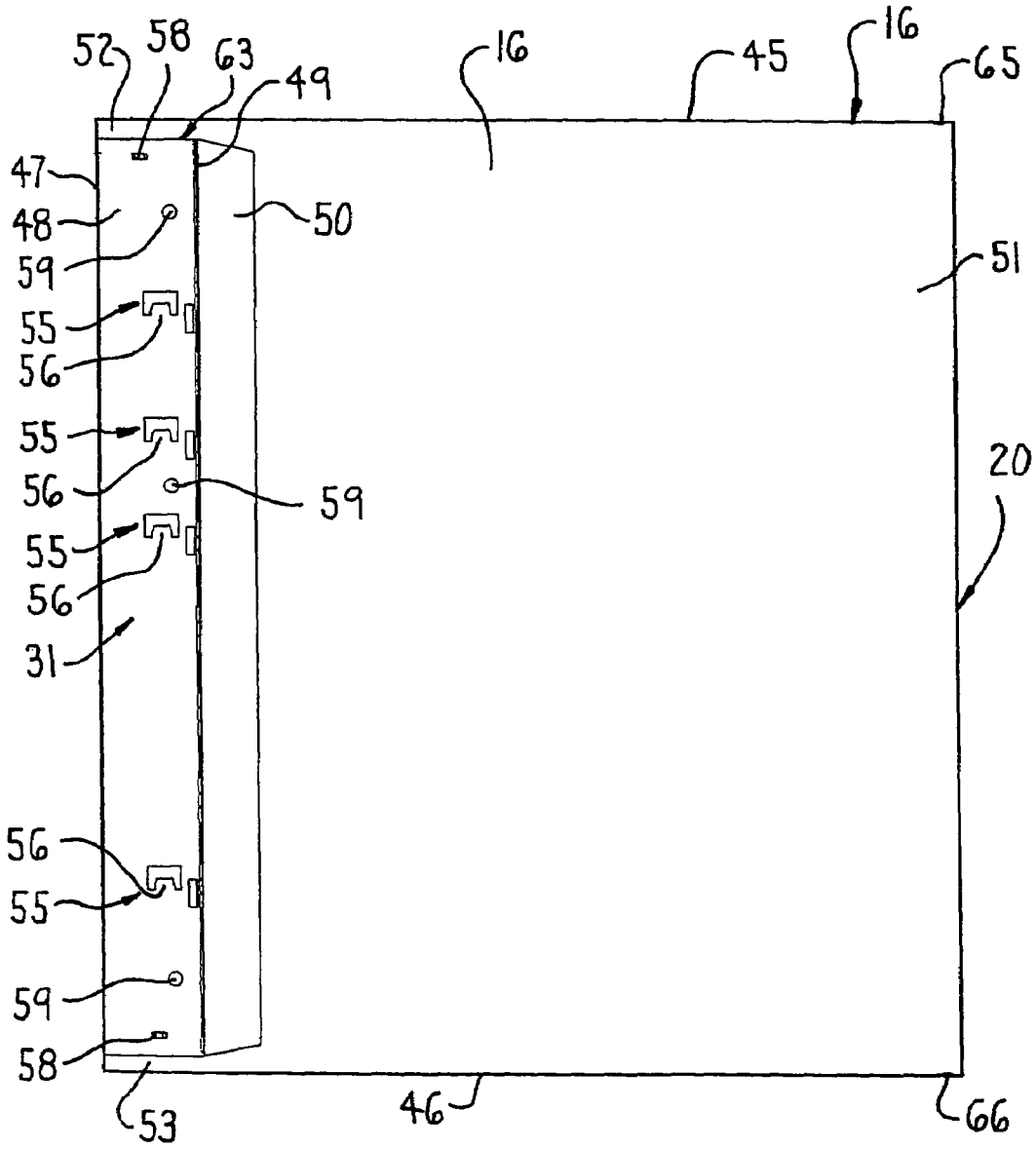
FIG. 6 is an enlarged right side view illustrating the left side wall of the housing wrapper.

More particularly as to the side walls 16 and 17, the side walls 16 and 17 are formed substantially the same and thus the following description primarily is directed to the left side wall 16 illustrated in FIGS. 6 and 7. The side walls 16 and 17 include inwardly projecting horizontal top and bottom flanges 45 and 46 (FIG. 3).

At the front edge section 21 of the side wall 16 as seen in FIGS. 6 and 7, the front most vertical edge is bent inwardly and rearwardly so as to form a hollow tubular reinforcing vertical edge support 31 along a substantial portion of the vertical height of the side wall 16. The vertical edge support 31 generally has a rectangular shape when viewed from above which is defined by a front facing section 47, an interior section 48 and a rearward facing section 49. A rearward-extending connector flange 50 abuts directly against an opposing interior surface 51 of the side wall 16 and is rigidly connected thereto by a plurality and preferably three spot welds 50A (FIG. 5).

The opposite ends of the edge support 31 terminate short of the upper and lower flanges 45 and 46 of the side wall 16 to thereby define upper and lower spaces 52 and 53. The spaces 52 and 53 are adapted to receive the opposite ends of the respective upper and lower rails 35 and 36 as generally illustrated in FIG. 5. The right edge support 32 similarly includes spaces 52 and 53.

To accommodate the drawer slides 40-43, the interior rail section 48 includes four formations of mounting openings 55 (FIG. 5) which support the forward most ends of the drawer slides 40-43. Each formation of openings 55 includes an upward-projecting support tab 56 as a part thereof. Additionally, the upper and lower ends of the vertical support 31 include slots 58 and holes 59 which are adapted to cooperate with additional cabinet components.

The vertical support 31 is thereby formed integral with the side wall material and as such the formation of the front facing wall 47 is an integral part of the vertical support 31 and rigidly supports the side wall 16 continuously along the entire vertical length of the support 31. The integral vertical supports 31 and 32 thereby eliminate separate support structures and provide improved support continuously along a vertical length of the side walls 16 and 17.

The opposite support 32 is formed substantially identical to the vertical support 31 as a mirror image thereof and thus, a detailed discussion of the vertical support 32 is not required. However, as seen in the top view of FIG. 10, the right side connector flange 50 further includes an inturned side flange 60 which thereby defines a vertical, inward-opening slide channel 61 along the vertical length of the right edge support 32. This slide channel 61 is adapted to receive and guide vertical sliding of a lock bar vertically therein which lock bar is adapted to selectively lockout the drawers 12. Such lock bars operate in a conventional manner and therefore the lock bar of the present file cabinet 10 is not disclosed in further detail herein.

Each side wall 16 and 17 extends rearwardly and terminates at the rear corners 18 and 19 wherein the side walls 16 and 17 are integrally joined to the back wall 20 along the entire vertical length of the corner. The back wall 20 has a rectangular shape and further includes inturned top and bottom flanges 65 and 66 which are formed substantially the same as the side wall flanges 45 and 46. The back wall 20 has an exterior finished surface 67 and an inward facing interior surface 68.

Figure 9:
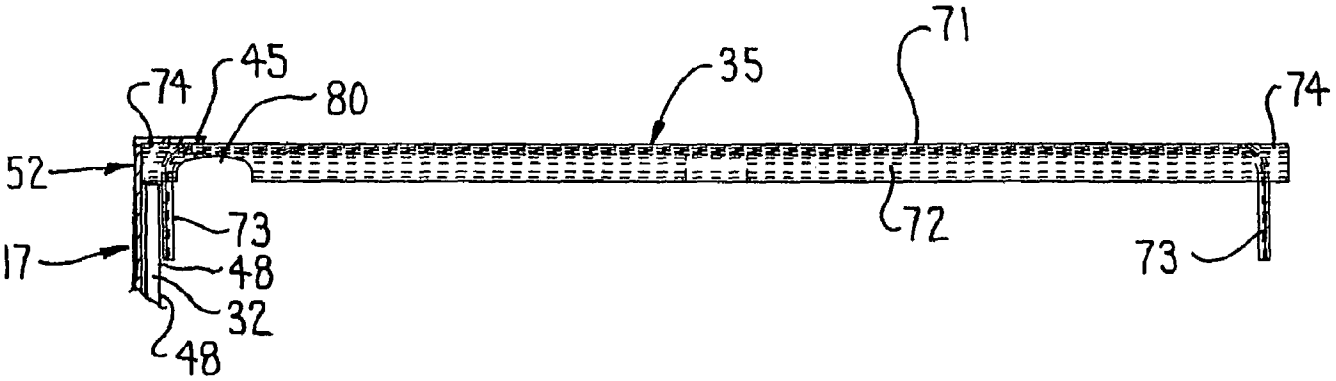
FIG. 9 is a front view of a top or upper cross rail.
Figure 10:
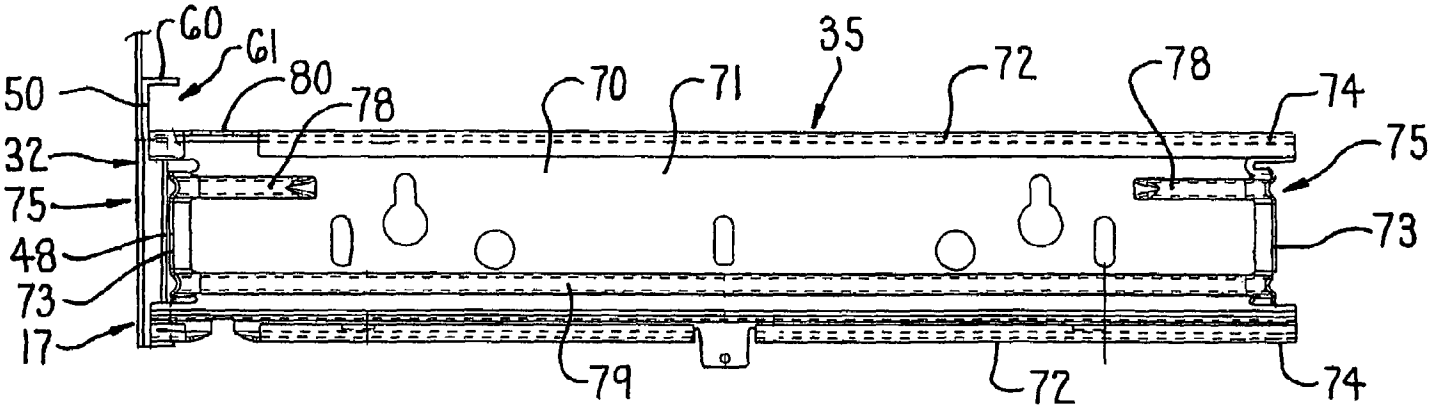
FIG. 10 is a plan view of the top cross rail.

Turning to the horizontal support structures, namely the upper and lower support rails 35 and 36, FIGS. 9 and 10 illustrate the top support rail 35 in detail. The top support rail 35 has a horizontally elongate central section 70 defined by a main central web 71 and downwardly depending edge flanges 72 which extend along the length of the central web 71.

The central web section 71 at the opposite ends thereof is bent downwardly so as to define plate-like mounting flanges 73. The side flanges 72 also have projecting portions 74 which project sidewardly beyond the mounting flange 73. The projecting portions 74 are adapted to fit into the spaces 52 that are formed directly above the respective rail 31 or 32. The projecting portions 74 and the mounting flanges 73 effectively define a notch 75 at each opposite end of the rail 35, wherein the mounting flanges 73 are thereby offset inwardly of the terminal ends of the projecting portions 74 so as to lie directly against the interior face 48 of the respective edge supports 31 and 32. Each mounting flange 73 is MIG welded to the respective vertical support 32 or 31. Further, the top flange 45 has a spot weld 77 at the upper end thereof which rigidly connects the web section 71 and upper flanges 45 together. This therefore provides a rigid corner connection between the cross rail 35 and the side walls 16 and 17.

To further rigidify the cross rail 35, the rail 35 includes short strengthening channels 78 which extend about the corner of the flanges 73 and also an additional strengthening channel 79 which extends across the entire length of the rail 35.

For the top cross rail 35, a semi-circular cutout 80 is formed through the side flanges 72 to permit acceptance of a lock assembly (not illustrated).

Figure 8:
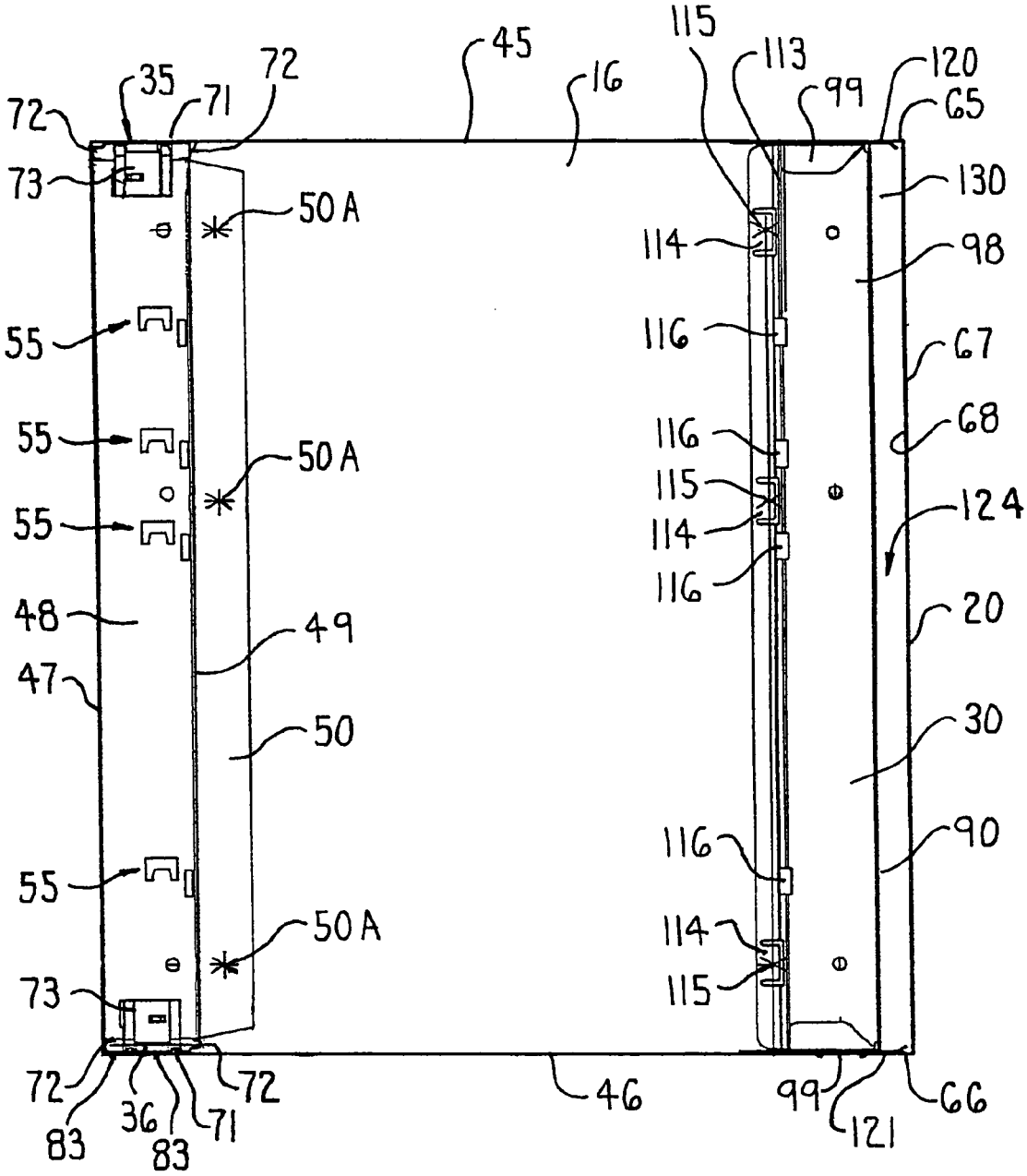
FIG. 8 is a right side view of the cabinet housing illustrating the left side wall thereof.
Figure 12:
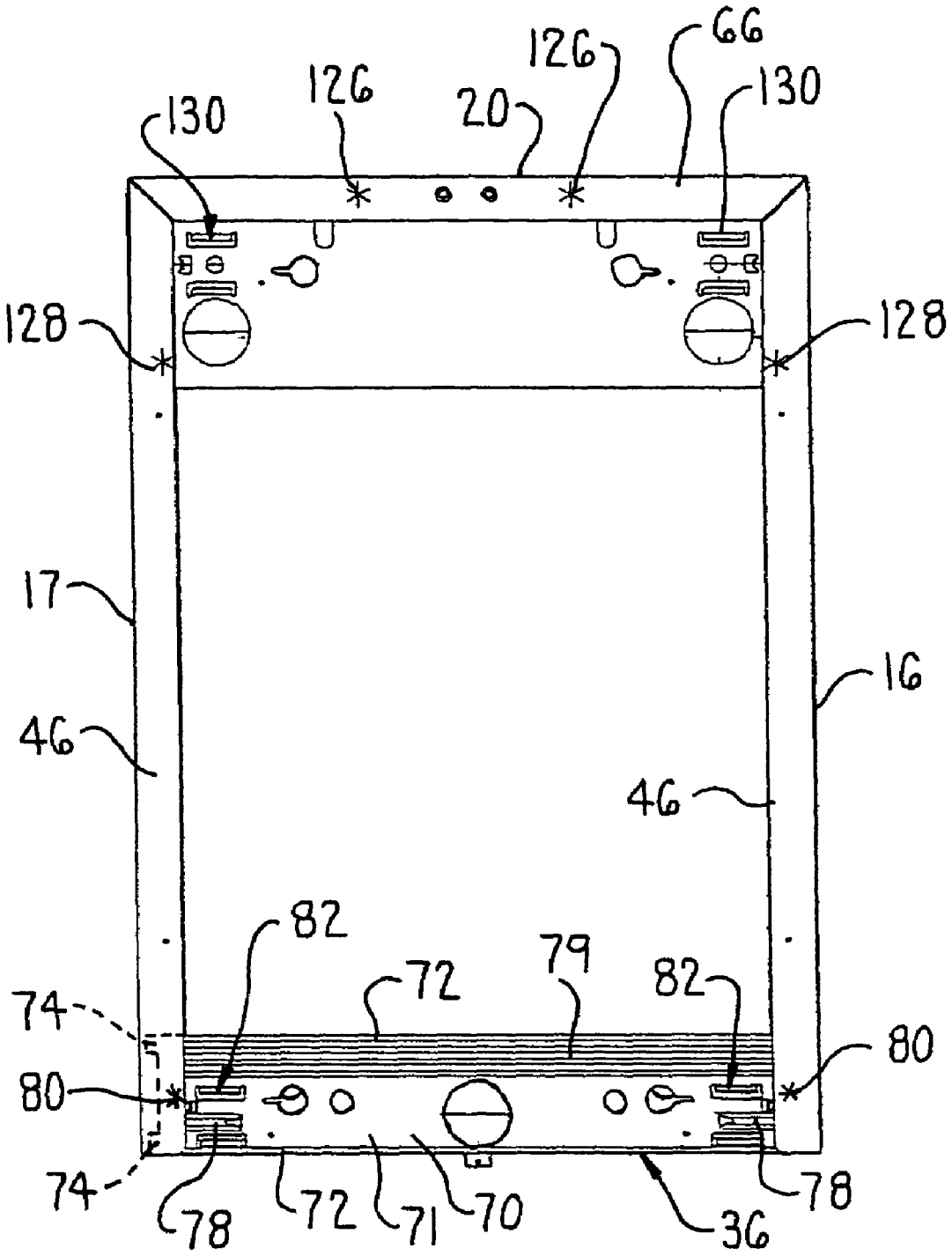
FIG. 12 is a bottom view of the cabinet housing.
Figure 16:
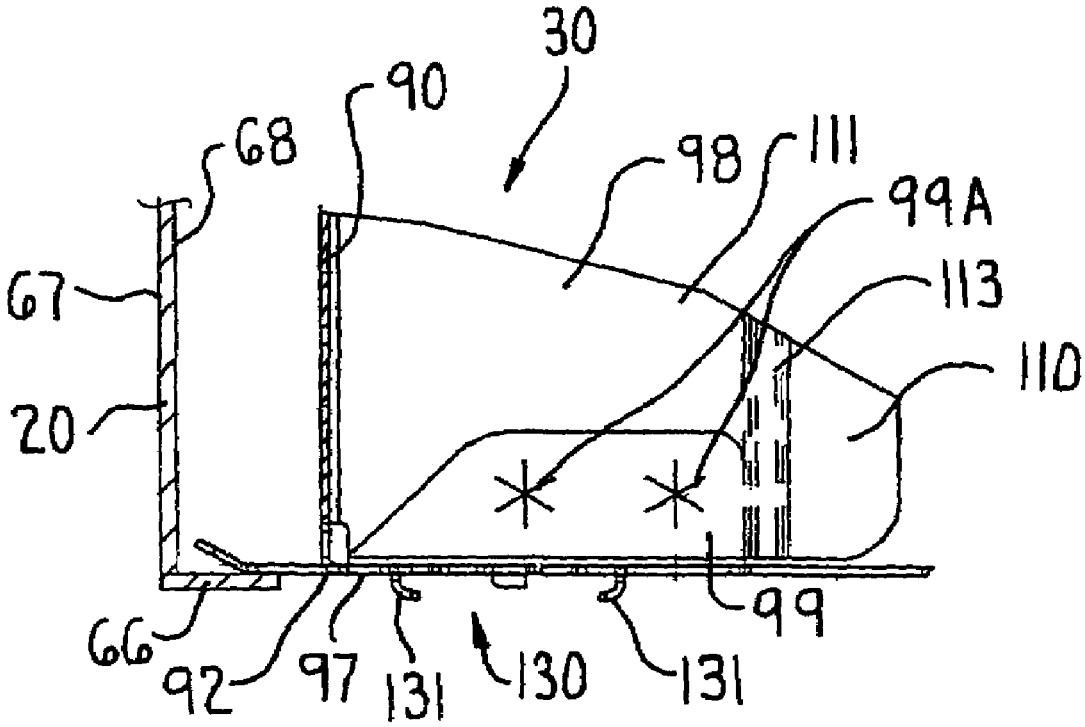
FIG. 16 is an enlarged partial left side view of the reinforcement box mounted in the housing adjacent the back wall.

Referring to FIGS. 8 and 12, the bottom cross rail 36 primarily is formed the same as the top cross rail 35 and similar components are identified by like reference numerals. Particularly, the cross rail 36 includes a center web 71 across the center section 70 thereof which has downwardly depending side flanges 72. The opposite ends of the rail 36 include upwardly projecting mounting flanges 73 which are MIG welded to the bottom of the respective edge support 31 or 32. The rail 36 further includes short strengthening channels 78 and 79.

The rail 36 also has projecting portions 74 which fit in the spaces 53 defined below the support rails 31 and 32 in substantially the same configuration as that illustrated in FIGS. 9 and 10, except that the associated mounting flanges 73 project upwardly rather than downwardly. The bottom rail 36 further is secured rigidly in place by additional spot welds 80 located and formed the same as the spot welds 77 at the top of the cabinet housing 11. Accordingly, the rails 35 and 36 are secured in place and the front corner components are rigidly joined together by a total of four MIG welds and four spot welds in addition to the three spot welds 52 provided for each support rail 31 and 32.

Referring to FIG. 12, the lower rail 36 also includes a pair of caster mounting formations 82 that are defined by a plurality of openings and downwardly projecting flanges 83. Each mounting formation 82 is adapted to support a respective one of the casters 26 thereon to thereby carry the weight of the cabinet. Further disclosure as to the mounting formations 82 and their interconnection to the casters 26 is not believed to be required.

Referring to FIGS. 13-15, the reinforcement box or insert 30 is generally formed as an open-sided box which opens forwardly. More particularly, the reinforcement box 30 has a generally rectangular and planar back panel 90 having a periphery defined by upper and lower horizontal edges 91 and 92 and opposite vertical side edges 93. The reinforcement box 30 is formed preferably of sheet metal and therefore the back panel 90 has a certain level of rigidity, particularly in the plane of the back panel 90. The box 30 is further formed from a single sheet of material wherein the peripheral edges of 91, 92 and 93 of the back panel 90 effectively define fold lines by which a plurality of and preferably four edge panels 95 are connected to the back panel 90. The side panels 95 each have a generally rectangular shape and project forwardly from the back panel 90 into a box-like configuration.

The edge panels 95 comprise an upper panel 96 and a lower panel 97 which extend across the lateral width of the back panel 90, and further comprise opposite side panels 98 which extend along the vertical height of the back panel 90. Each of the upper and lower panels 96 and 97 include vertical weld flanges 99 which abut against the inside face 100 of each side panel 98 and are spot welded thereto. As such, the upper box corners 101 and lower box corners 102 have significant rigidity wherein the rectangular configuration defined by the side panels 96, 97 and 98 are rigidly supported in such rectangular configuration by the back panel 90. Therefore, the box configuration has significant rigidity, particularly in the lateral direction of the cabinet since the back panel 90 and side panels 96, 97 and 98 mutually support each other, which rigidity thereby prevents racking or lateral deflection of the side panels 95. It will be understood the reinforcement box 30 may have alternate box-like configurations.

Figure 17:
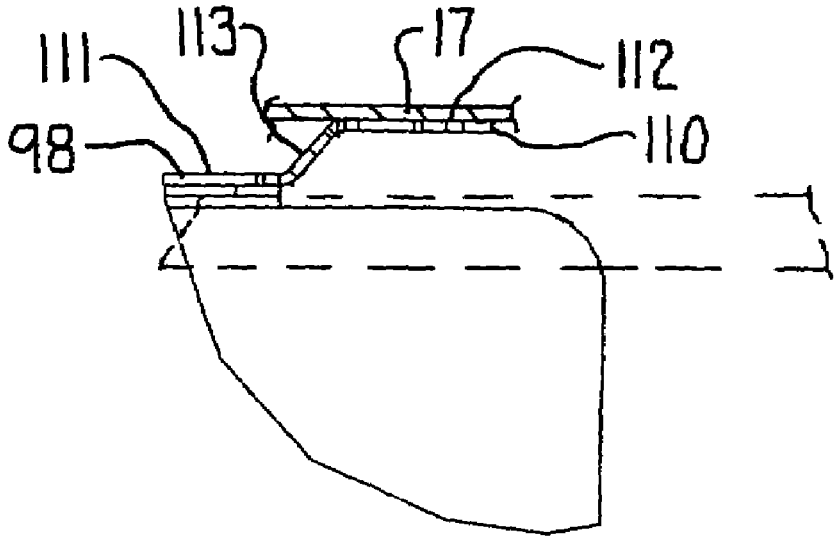
FIG. 17 is an enlarged partial plan view of a vertical side panel of the reinforcement box.

The reinforcement box 30 has a lateral dimension which is smaller than the lateral width between the interior surfaces of the side walls 16 and 17 such that the box 30 is able to slidably fit within the hollow interior of the cabinet housing 11, adjacent to the back wall 20. To secure the reinforcement box 30 in position, each side panel 98 has a front edge section 110 which is offset or stepped outwardly so as to abut directly against the opposing surfaces of the side walls 16 and 17. As seen in FIG. 17, the side wall 98 has a primary panel section 111 which forms the majority of the front to back dimension thereof, and the front edge of the panel section 111 is bent outwardly to define a welding flange 112 that is joined to the panel section 111 by an offset portion 113.

Each mounting flange 110 has three U-shaped cutouts which each define a welding tab 114 that abuts against the side wall 16 or 17 and is slightly deflectable to ensure snug contact with the side wall 16 or 17. Three such welding tabs 114 are defined along the vertical length of each side panel 98. As illustrated in FIG. 8, each welding tab 114 is welded to a respective side wall 16 or 17 by spot welds 115. These spot welds 115 are located a spaced apart distance disposed forwardly of the cabinet back wall 20 and serve to rigidly secure the side panels 98 to the side walls 16 and 17 effectively along a vertical length thereof.

To support the drawer slides 40-43, each side panel 98, and in particular the offset portion 113 thereof, includes four vertically spaced apart notches 116 which open forwardly and are adapted to receive respective mounting projections provided on the rearmost ends of the drawer slides 40-43.

Figure 11:
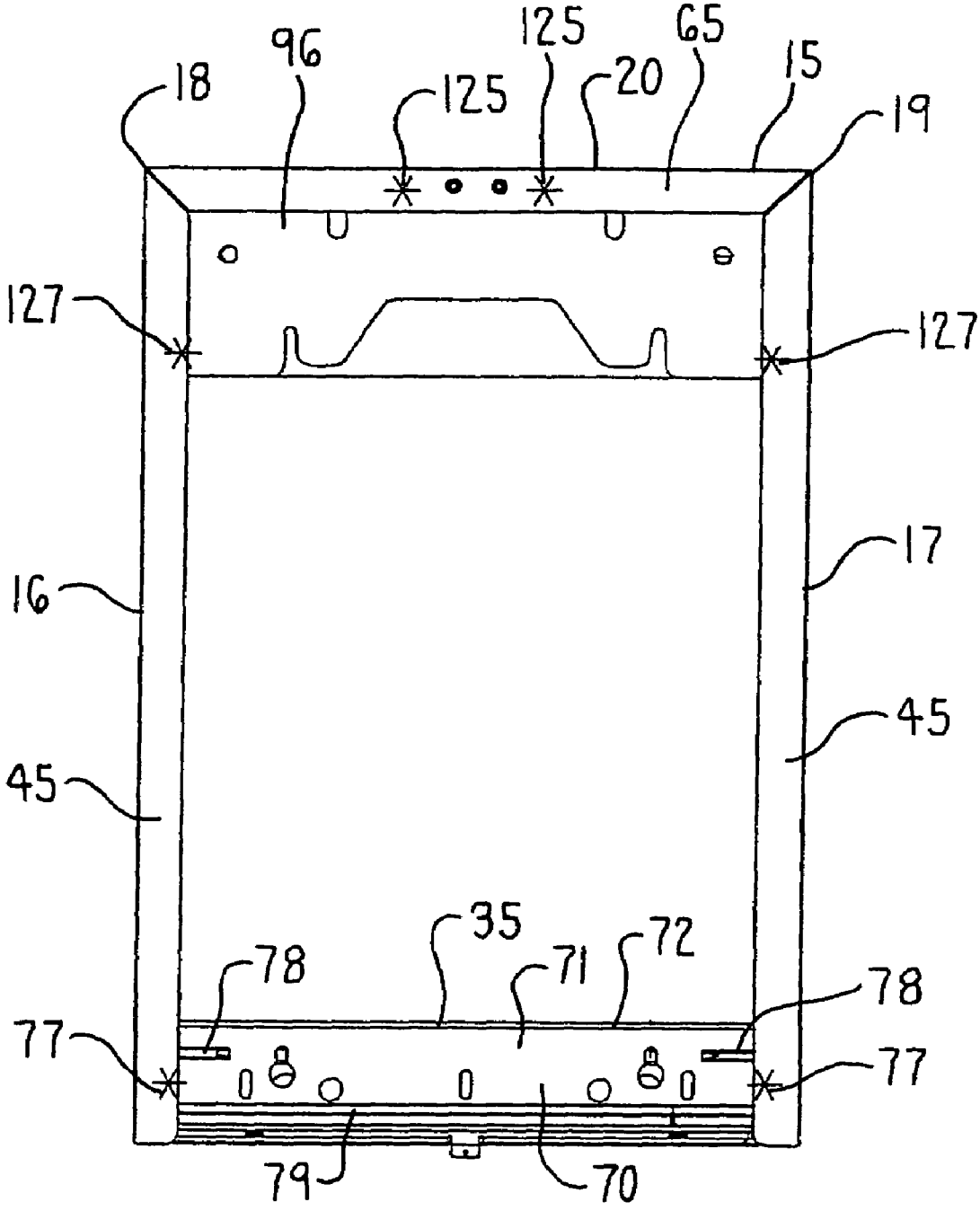
FIG. 11 is a plan view of the cabinet housing.

To further locate the reinforcement box 30 within the cabinet housing, the upper and lower panels 96 and 97 include horizontal locator flanges 120 and 121 which project rearwardly of the back panel 90. The locator flanges 120 and 121 are formed from cutouts 122 in the back panel material which cutouts 122 are then bent upwardly or downwardly to form the rearwardly projecting locator flanges 120 and 121. These locator flanges 120 and 121 serve to locate the back panel 90 of the box 30 a predetermined distance forwardly of the interior face 68 of the cabinet back wall 20. This defines a hollow space 124 therebetween. Further, the locator flanges 120 and 121 abut against a lower surface of the cabinet wall flanges 65 and 66 to permit formation of spot welds 125 (FIG. 11) and 126 (FIG. 12). Further, the top and bottom panels 96 and 97 also abut against the under surfaces of the top side wall flanges 45 and the bottom side wall flanges 46 and are rigidly connected thereto by spot welds 127 (FIG. 11) and 128 (FIG. 12).

As such, the cabinet housing has a double wall construction formed at the back thereof wherein the opposing cabinet back wall 20 and box back panel 90 as well as the rearmost side wall portions 130, which enclose the sides of the space 124, effectively define a tubular, vertical reinforcement column within the housing. This column therefore has a rectangular, tubular configuration. This serves to further rigidify the cabinet housing 11.

However, since the reinforcement box 30 opens forwardly, the reinforcement box 30 forms part of the interior space of the cabinet 10 and is able to receive the rear portions of the drawer slides 40-43 and the drawers 12 therein such that the addition of the column space 124 does not result in a significant increase in the overall front to back depth of the cabinet 10.

While the back wall 20 would serve to generally rigidify the side walls 16 and 17 through its connection thereto, the addition of the reinforcement box 30 and its attachment to the side walls 16 and 17 a significant distance and preferably, about ¾ of an inch, from the back wall 20 results in the box back panel 90 functioning to not only rigidify the housing but provide such rigidity to the side walls 16 and 17 a distance spaced forwardly from the back wall 20.

In addition to the foregoing, the box bottom panel 97 also is provided with two caster mounting formations 130 which are formed substantially identical to the mounting formations 82 on the lower cross rail 36. The mounting formations 130 generally include downwardly projecting tabs 131 and are formed identical to the formations 82 wherein further discussion of the formations 130 is not required. Generally these mounting formations 130 are adapted to support the rear casters 36.

Additionally, the reinforcement box 30 has an inherent weight which serves to counterbalance the weight of the drawers 12. Typically, a conventional cabinet has a separate plate attached to the back housing wall thereof which serves as a counterweight. The weight of the reinforcement box however serves a counterbalancing function to thereby reduce the overall weight of an additional counterweight which might be added to the cabinet. As seen in FIG. 4, the back panel 90 of the reinforcement box 30 also includes a rectangular counterweight 140 affixed thereto. This counterweight 140 effectively is a steel plate having a selected weight defined by the overall height, width and thickness of the counterweight 140. Counterweight 140 is secured in place by suitable fasteners. The reinforcement box 30 also may be designed so that the weight of the material used and its thickness provides the entire weight that is required to counterbalance the drawers 12. As such, the reinforcement box 30 may have a weight which inherently functions as the entire counterweight required in the cabinet 10.

During assembly, the cabinet wrapper 15 is folded into the configuration of the side walls 16 and 17 and the back wall 20 after which, the cross rails 35 and 36 are MIG welded and spot welded in position. Additionally, the reinforcement box 30 is positioned within the cabinet housing 11 by the locator flanges 91 and 92 and then spot welded in position. Thereafter, casters 36 may be installed and the appropriate drawer slides 40-43 mounted to both of the side walls 16 and 17. After which, a front trim piece 135 (FIG. 2) is mounted to the cabinet housing 11 so as to completely enclose the top cross rail 35. After which, the top wall 25 is mounted to the top edges of the cabinet housing 11 to appropriate keyhole-type openings in the top cross rail 35 and forward-opening slots in the front edge of the box top panel 96.

Referring to FIGS. 18-31, a second embodiment of a storage cabinet is illustrated and referenced therein by reference numeral 10-1. This storage cabinet 10-1 possesses substantially the same structural construction as that previously discussed relative to storage cabinet 10 wherein the following discussion is primarily directed to improvements in the connection of the upper and lower cross rails 35-1 and 36-1 to the housing wrapper 15-1. The following discussion uses common reference numerals with a suffix "-1" added thereto to identify the component as being part of the storage cabinet 10-1. It will be understood that the previous discussion relative to cabinet 10 applies the same to the following discussion and hence, the disclosure as to cabinet 10-1 is primarily directed to the differences therebetween.

Figure 18:
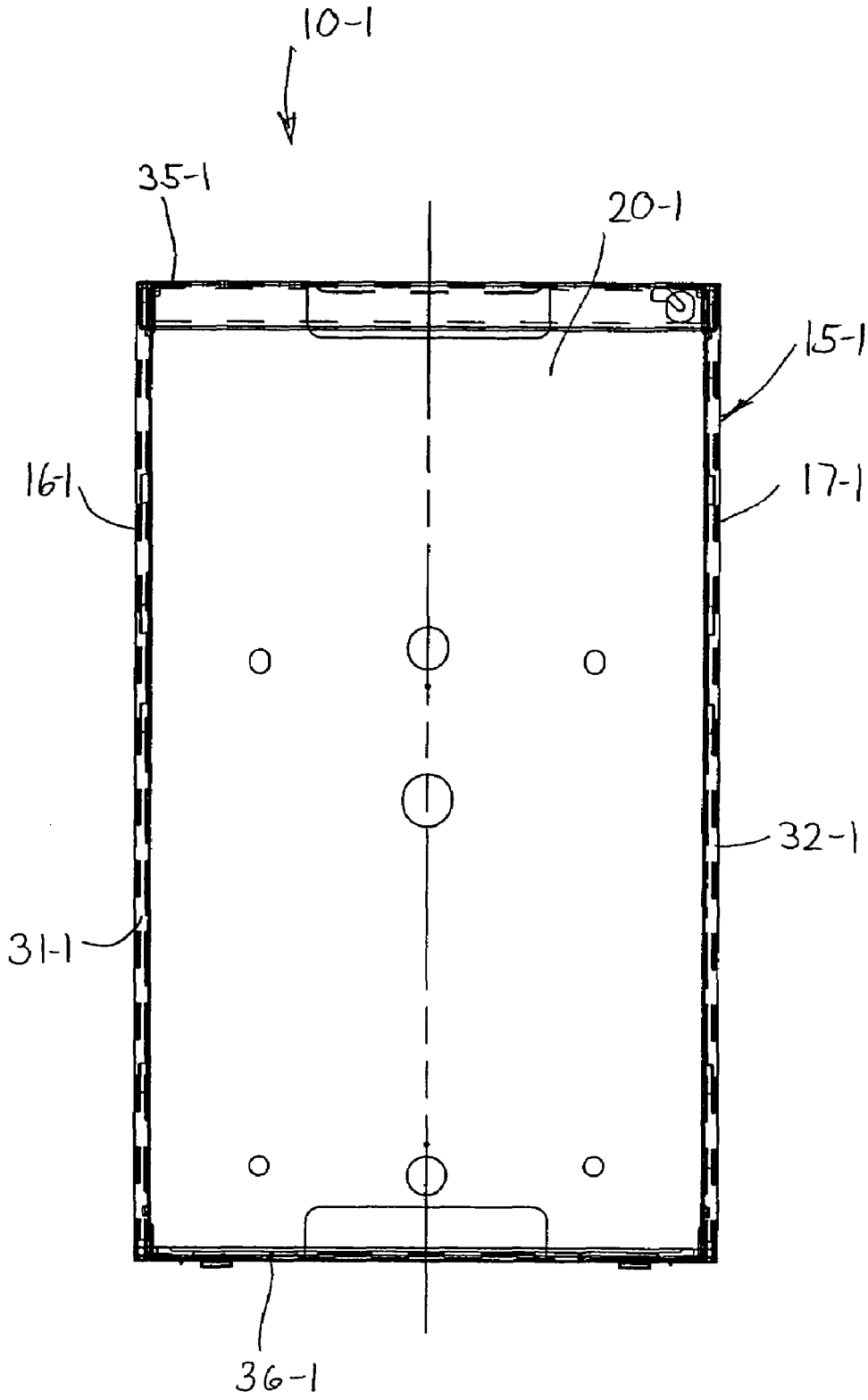
FIG. 18 is a front elevational view of a cabinet housing of a second embodiment of the invention.
Figure 19:
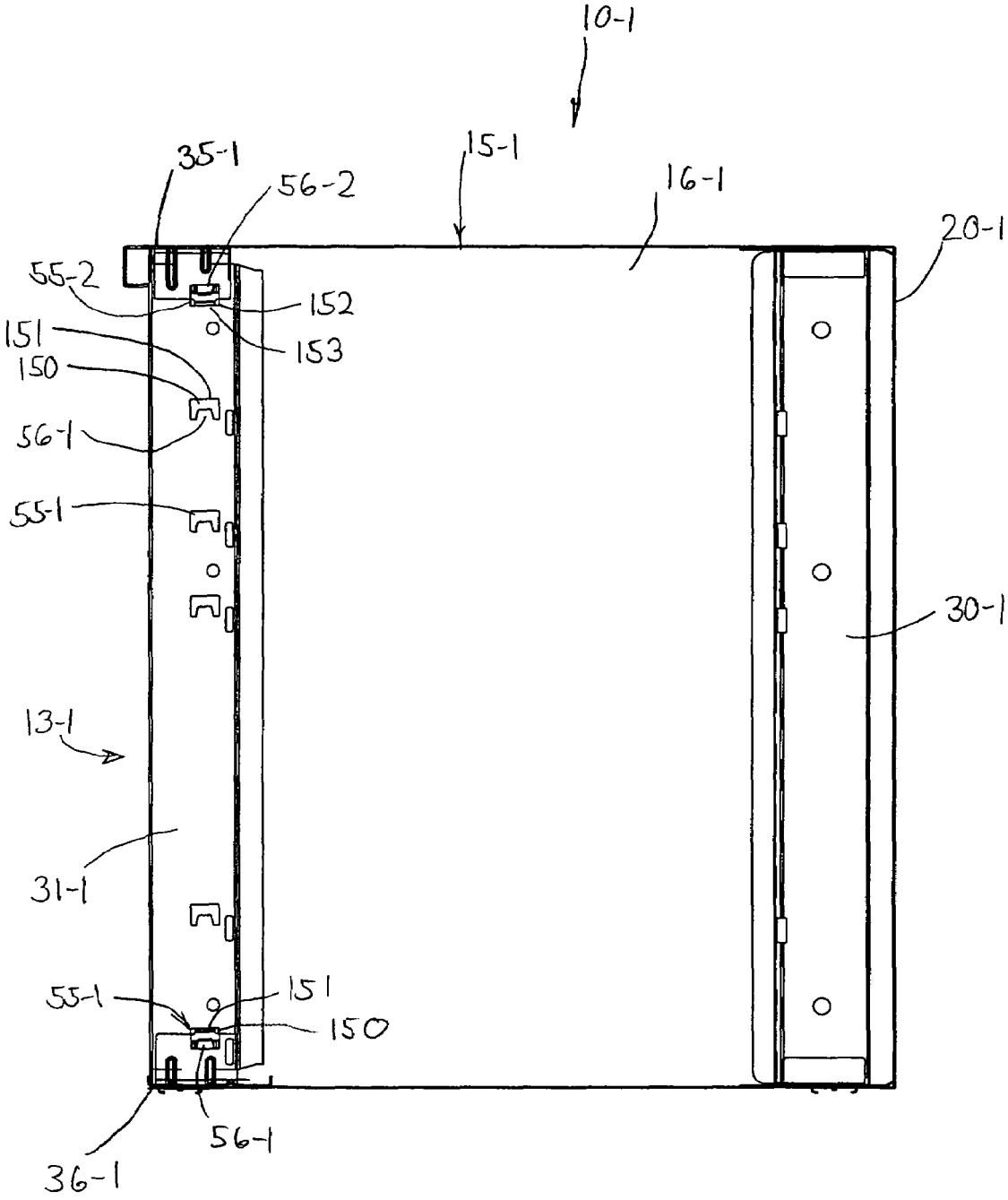
FIG. 19 is a left side elevational view illustrating the interior of the left side wall of the cabinet housing.

As illustrated in FIGS. 18 and 19, the housing wrapper 15-1 is formed with side walls 16-1 and 17-1 as well as back wall 20-1. The side walls 16-1 and 17-1 include tubular reinforcement edge supports 31-1 and 32-1 along the front vertical edge thereof which are spaced apart to define the open front side 13-1.

The reinforcement edge supports are formed the same as that described above except that they are modified to provide a more secure and improved connection with the respective ends of the upper cross rail 35-1 and lower cross rail 36-1. The edge supports 31-1 and 32-1 include interior face sections 48-1 and have a connector flange 50-1 securely joined to the respective wrapper side wall 16-1 or 17-1 by welding.

Figure 20:
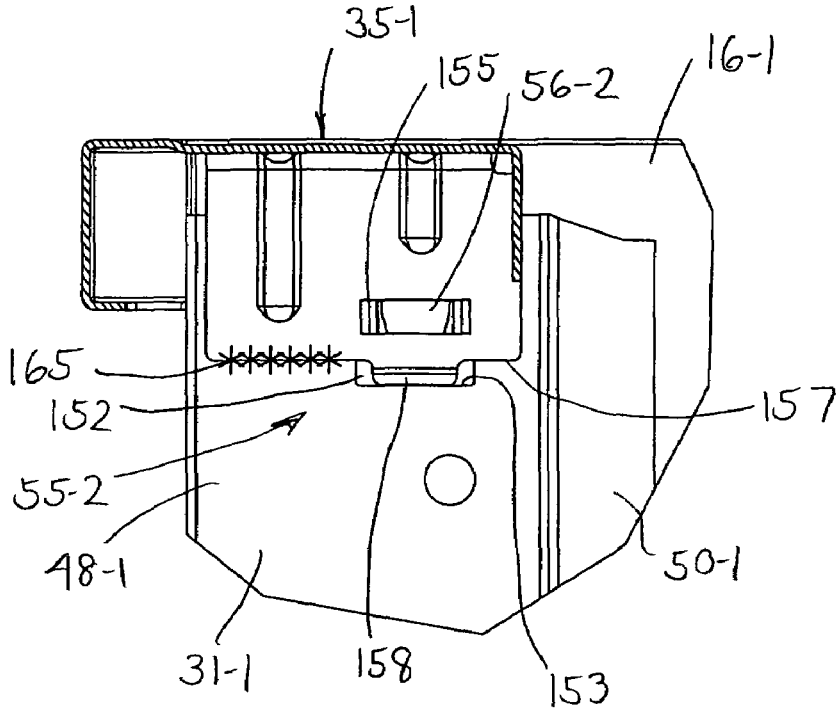
FIG. 20 is a partial cross-sectional side view of an improved top cross rail joined to the housing wrapper.
Figure 21:
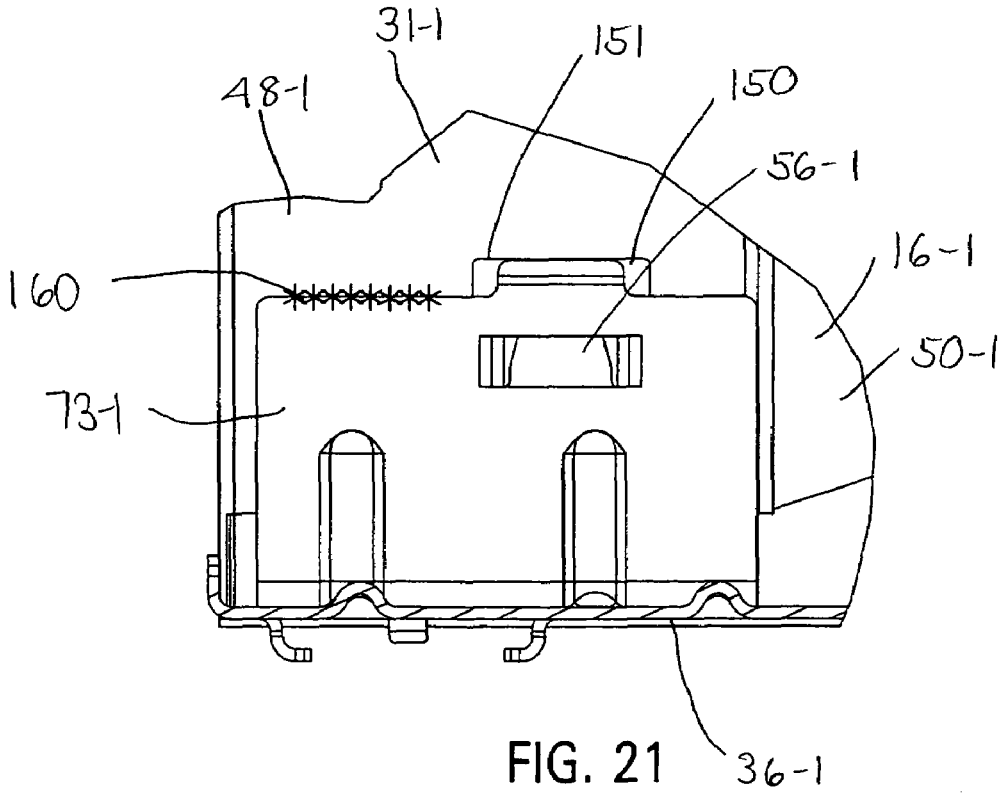
FIG. 21 is a partial cross-sectional side view illustrating an improved lower cross rail joined to the housing wrapper.

Referring to FIGS. 19-21, the edge supports 31-1 and 32-1 include the same pattern of four interior formations of mounting openings 55-1 which comprise a support tab 56-1 and a U-shaped slot 150 around the support tab 56-1 which slot 150 defines an upper horizontal slot edge 151. An additional formation of mounting openings 55-1 is provided at each lower end of the edge supports 31-1 and 32-1 to support the opposite ends of the lower cross rail 36-1. In this lower opening formation 55-1, the support tab 56-1 projects upwardly with the upper edge 151 of the slot 150 disposed above the tab 56-1. An additional formation of mounting openings 55-2 is provided at the top of each edge support with the primary difference being that the support tab 56-2 projects downwardly and is surrounded by the Ushaped slot 152 that defines a horizontal lower edge 153.

Figure 22:
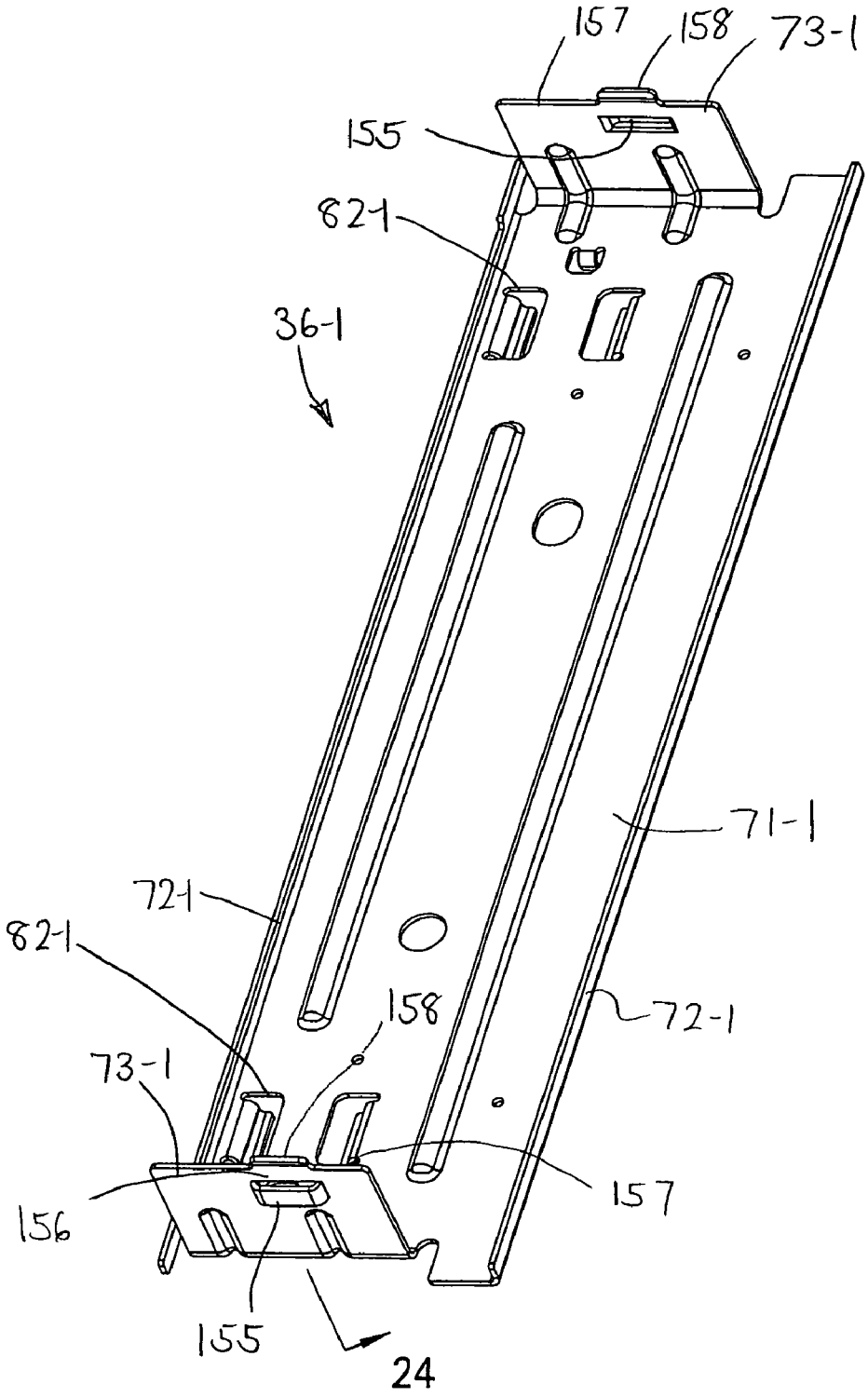
FIG. 22 is a perspective view of the lower cross rail.
Figure 23:
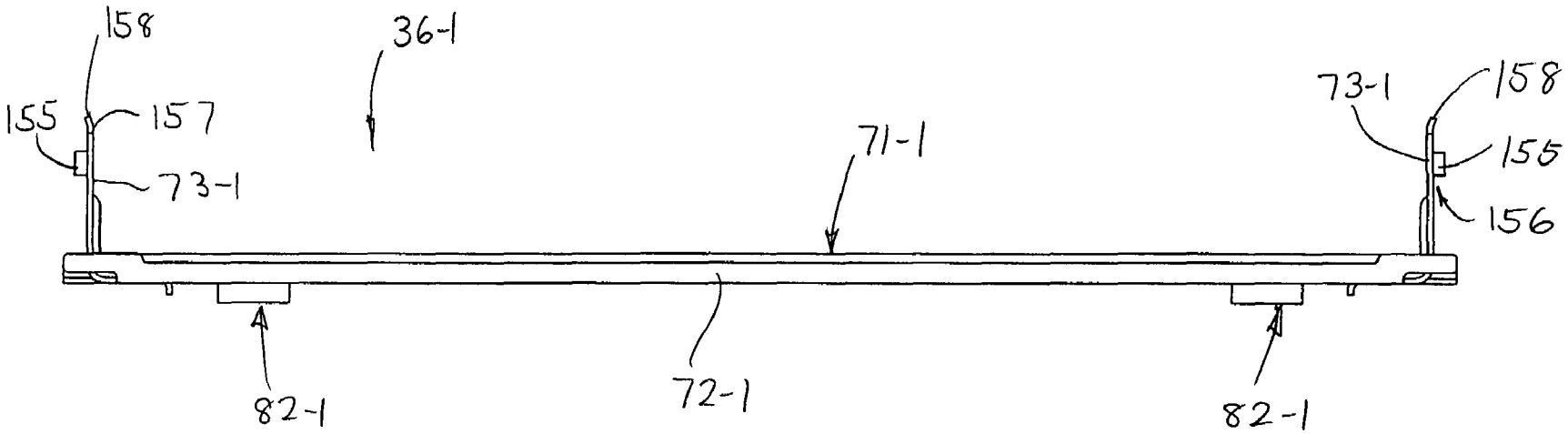
FIG. 23 is a front elevational view of the lower cross rail.
Figure 26:
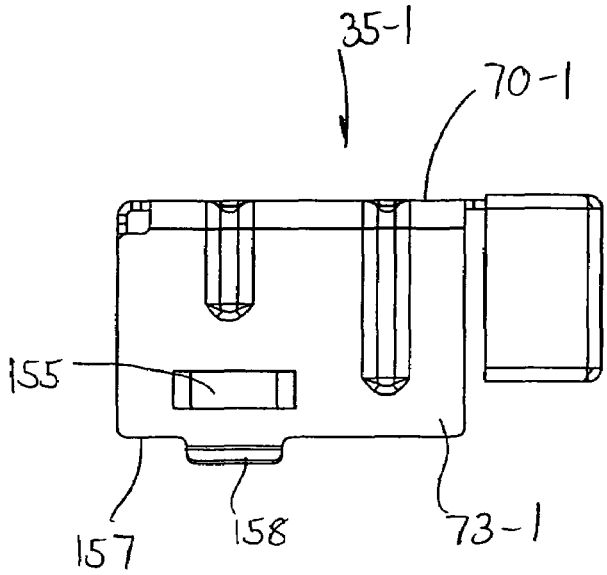
FIG. 26 is a right side view of the top cross rail.

Referring to FIGS. 21-23, the lower cross rail 36-1 includes a center web 71-1 that has upwardly projecting side flanges 72-1. The opposite ends of the rail 36-1 include mounting flanges 73-1 which are adapted to be welded in place as described previously. The mounting flanges 73-1 each further include an outwardly projecting strap 155 which thereby defines an opening 156 passing vertically through the strap 155. The flange edge 157 further has a locking tab 158 which projects vertically and outwardly. A formation of the strap 155 and the locking tab 158 cooperate with the lowermost support tab 56-1 and the slot 150 disposed thereabout.

Figure 24:
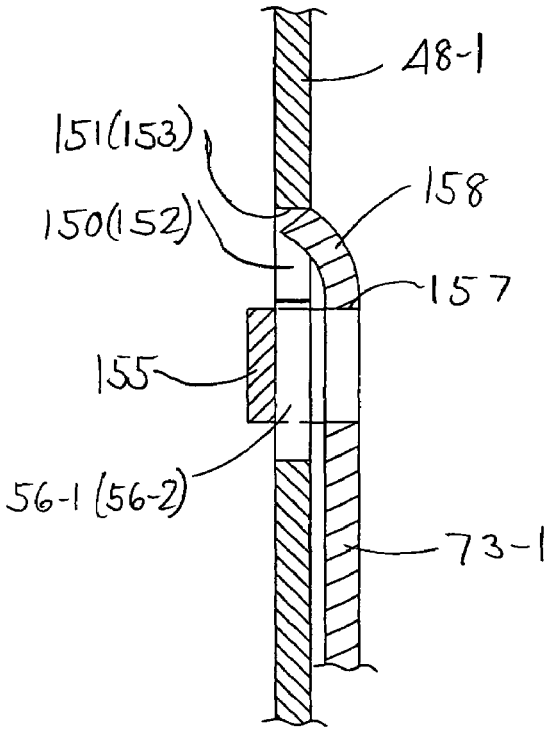
FIG. 24 is a side cross sectional view illustrating an end flange of either of the upper or lower cross rails connected to the housing wrapper.

More particularly, when assembling the cabinet, the lower cross rail 36-1 is slid downwardly into place wherein the mounting strap 155 is slid sidewardly into the opening 150 and then slid downwardly onto the support tab 56-1 as seen in FIG. 24. When slid into place, the locking tab 158 slides downwardly below the slot edge 151 and then snaps therebelow so as to prevent upward disengagement of the lower cross rail 36-1. Therefore, during preliminary assembly, the lower cross rail 36-1 may be slid downwardly and then snap-locked in place at its opposite ends. Thereafter, during final assembly, a further weld 160 (FIG. 21) is then added to the mounting flange 73-1 to provide a secure and rigid connection.

The upper cross rail 35-1 is formed similarly. Referring to FIGS. 25-28, the cross rail 35-1 includes a central section 70-1 having mounting flanges 73-1 projecting downwardly therefrom. The mounting flanges 73-1 further include a mounting strap 155 projecting outwardly therefrom and a locking tab 158 which projects downwardly from the lower flange edge 157. The strap 155 and locking tab 158 cooperate with the upper opening formation 55-2 but since the support tab 56-2 projects downwardly, the upper cross rail 35 is assembled by first engaging the connector straps 155 sidewardly into the opening 152 and then the upper cross rail 35-1 is slid upwardly until the locking tab 158 snaps over and abuts against the lower slot edge 153 as illustrated in FIG. 20. The cross sectional view (FIG. 24) of the cooperating parts described above is illustrated substantially the same as FIG. 24 except that FIG. 24 would be reversed top to bottom. As seen in FIG. 20, final assembly of the cabinet 10-1 results in an additional weld 165 being applied between the mounting flange 73-1 and the vertical edge support 48-1.

With the foregoing arrangement, the upper and lower cross rails 35-1 and 36-1 are readily connected to the side walls 16-1 and 17-1 during preliminary assembly and then permanently affixed in place by the addition of the welds of 160 and 165 illustrated in FIGS. 21 and 20 respectively.

Figure 25:
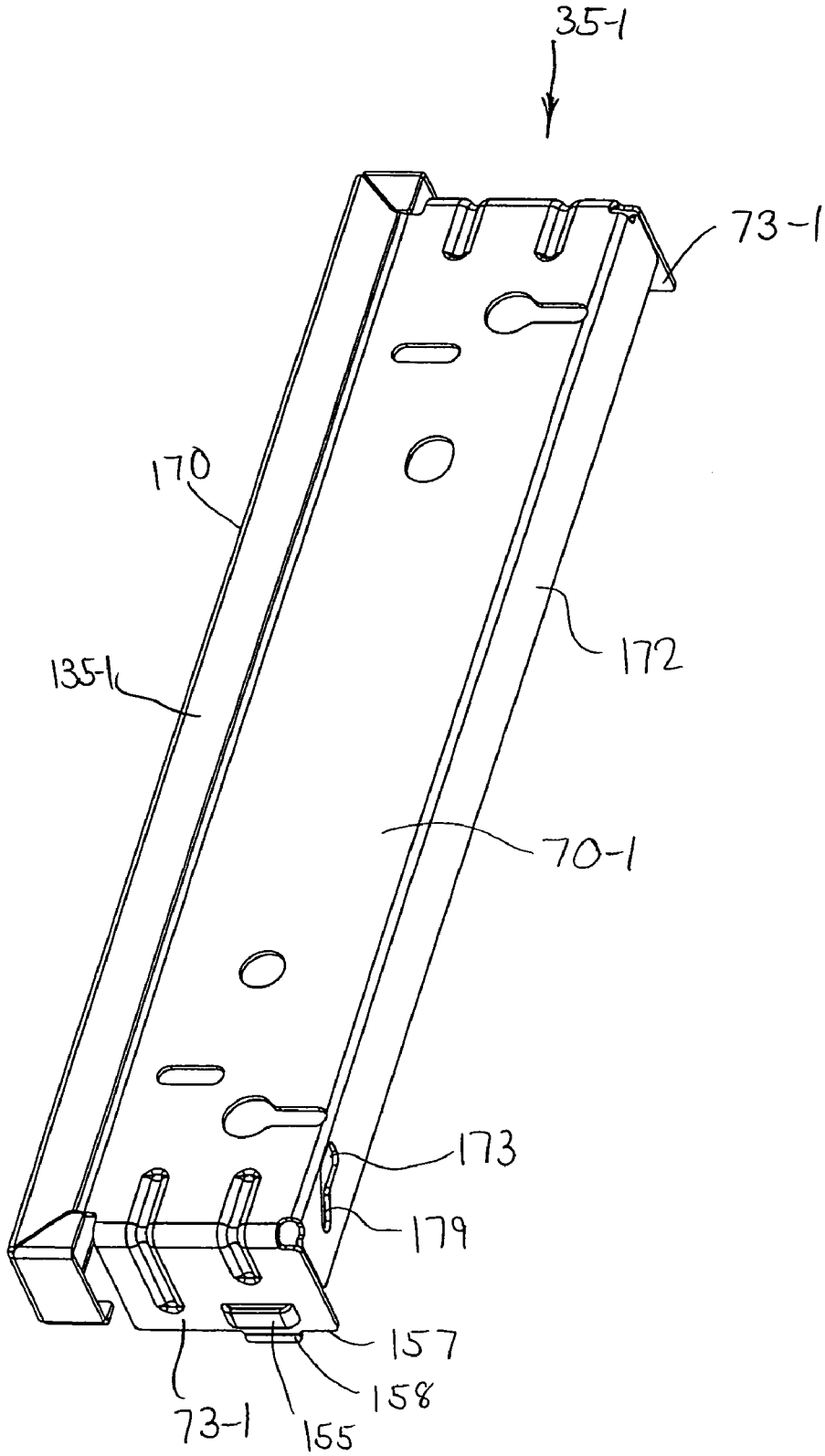
FIG. 25 is a perspective view of the top cross rail.
Figure 27:
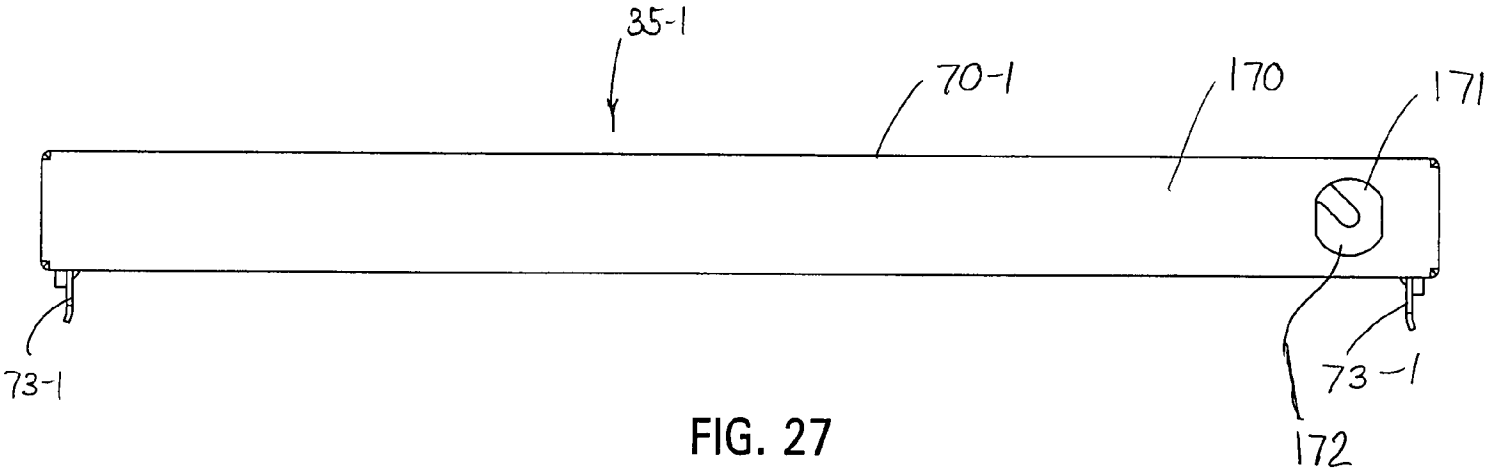
FIG. 27 is a front elevational view of the top cross rail.
Figure 28:
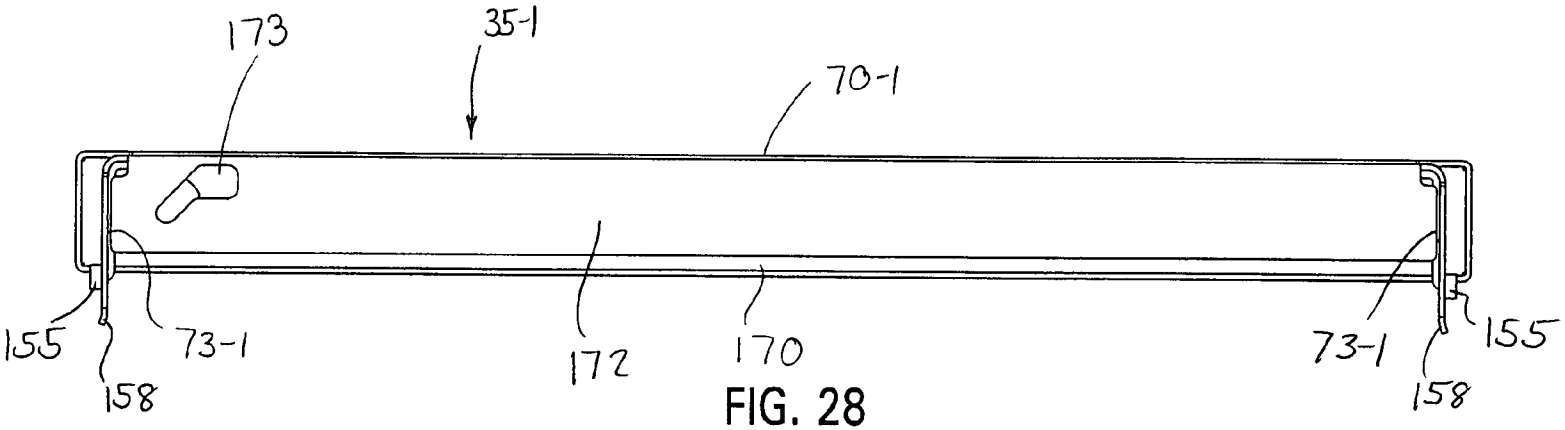
FIG. 28 is a rear elevational view of the top cross rail.

Further as to the top cross rail 35-1, this top cross rail is formed integral with a front trim piece 135-1. The front trim piece 135-1 as illustrated in FIGS. 25, 27 and 28 is formed of metal into a generally rectangular shape which trim piece 135-1 includes a downwardly depending front face 170. The front face 170 includes a somewhat oval lock seat 171 under one corner thereof.

Further, the cross rail 35-1 includes a back wall 172 which depends downwardly and has a support slot 173 formed therein in partial alignment with the lock seat 171. The front face wall 170 and the back wall 172 are adapted to support a lock assembly 175 therein.

The lock assembly 175 includes a lock shell 176 rigidly secured within the lock seat 171 and also has a rotatable shaft 177 projecting rearwardly therefrom. The shaft 177 has a stepped section 178 which fits into a slotted portion 179 of the slot 173 as illustrated in FIG. 31.

With the foregoing arrangement, the lock assembly 175 can be preassembled onto the top cross rail 35-1 prior to assembly on the cabinet, or the lock assembly 175 may be fitted in position after final assembly. In any event, a lock assembly 175 is then independently supported on the top cross rail 35-1 to thereby form the rail assembly.

Referring to FIGS. 32-42, the storage cabinet 200 is a third embodiment of the invention which incorporates the concepts of the invention therein. The storage cabinet 200 includes several compartments formed therein which define a pedestal section 201, a storage compartment 202 and a wardrobe compartment 203 which extends the full height of the storage cabinet 200. The storage section 202 is defined by an upper cabinet module and is stacked on the pedestal section 201, which pedestal section 201 constitutes a lower cabinet module. The lower module is formed similar to the above-described storage cabinets as discussed in further detail herein.

Figure 32:
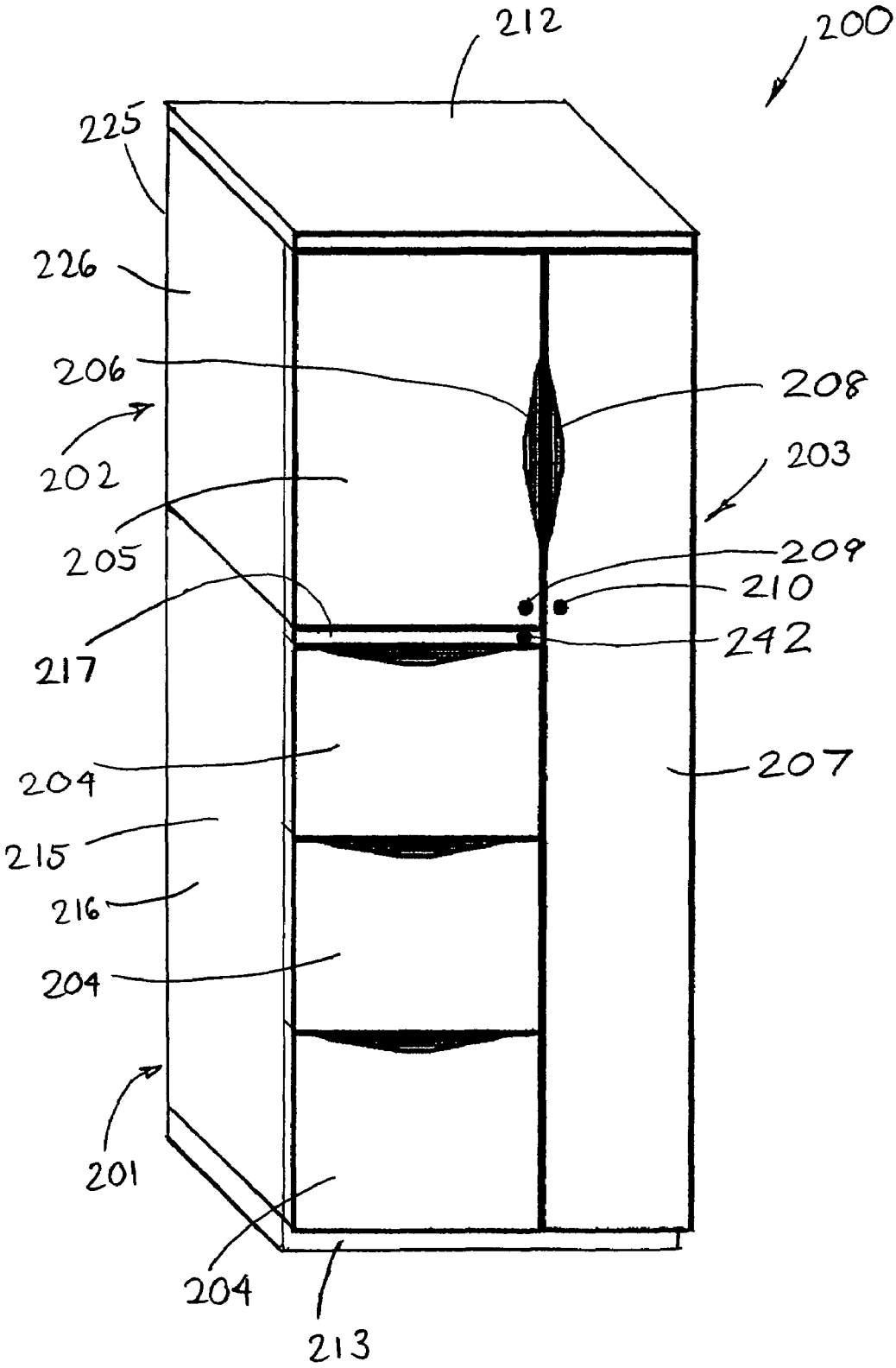
FIG. 32 is a front isometric view of a further embodiment of a storage cabinet of the invention.
Figure 33:
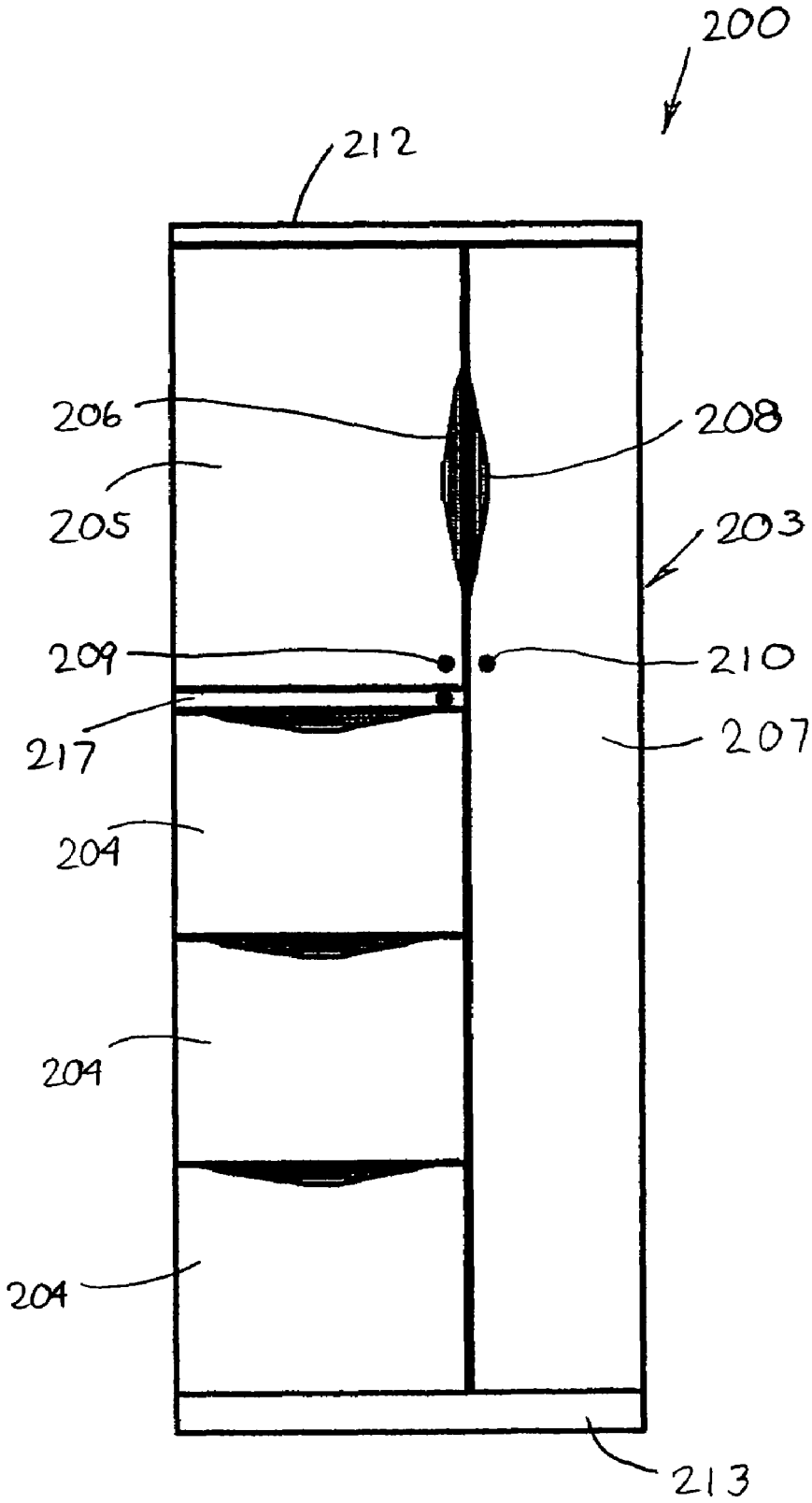
FIG. 33 is a front elevational view thereof.
Figure 34:
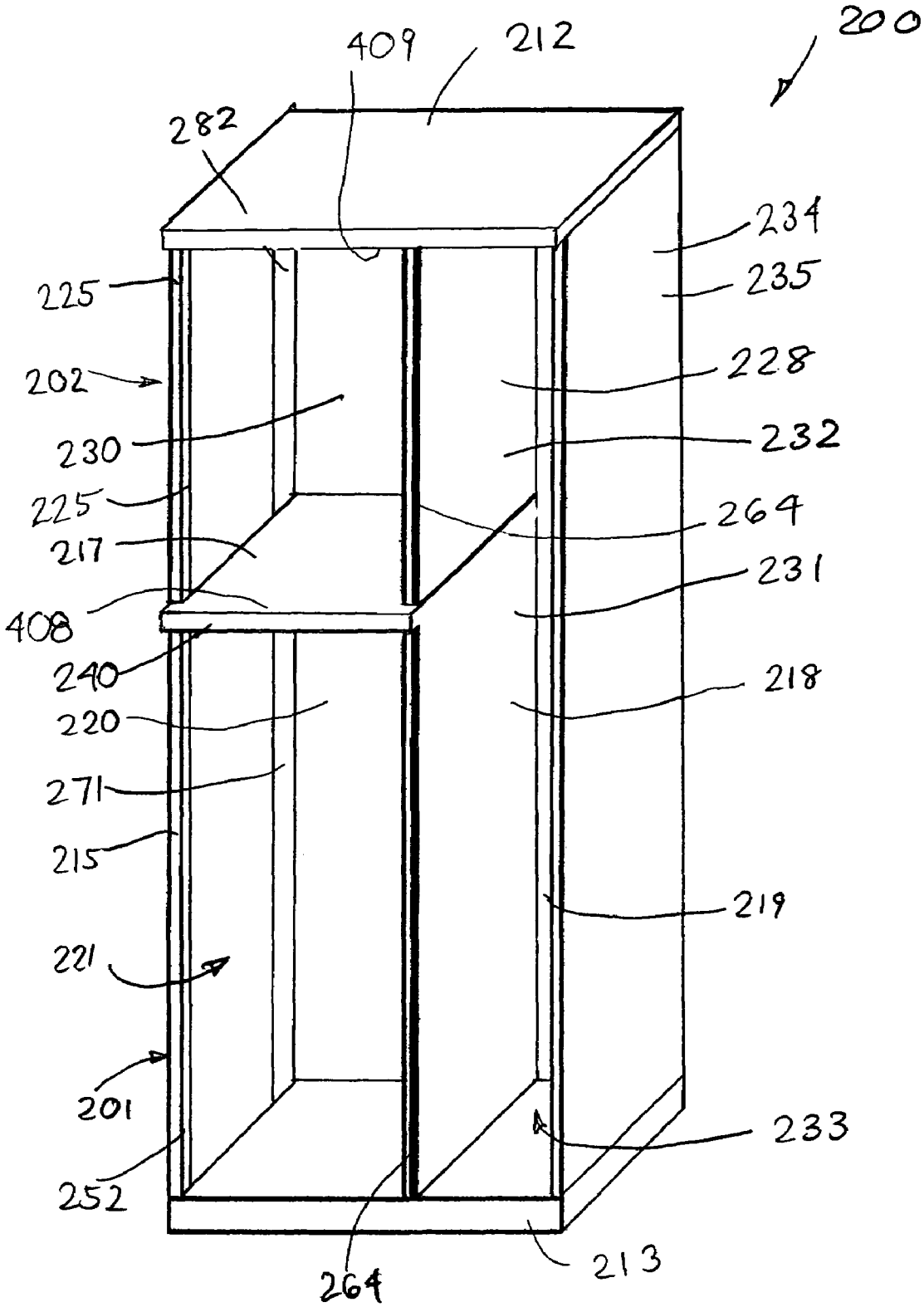
FIG. 34 is an isometric view of the cabinet housing with file drawers and doors removed.
Figure 35:
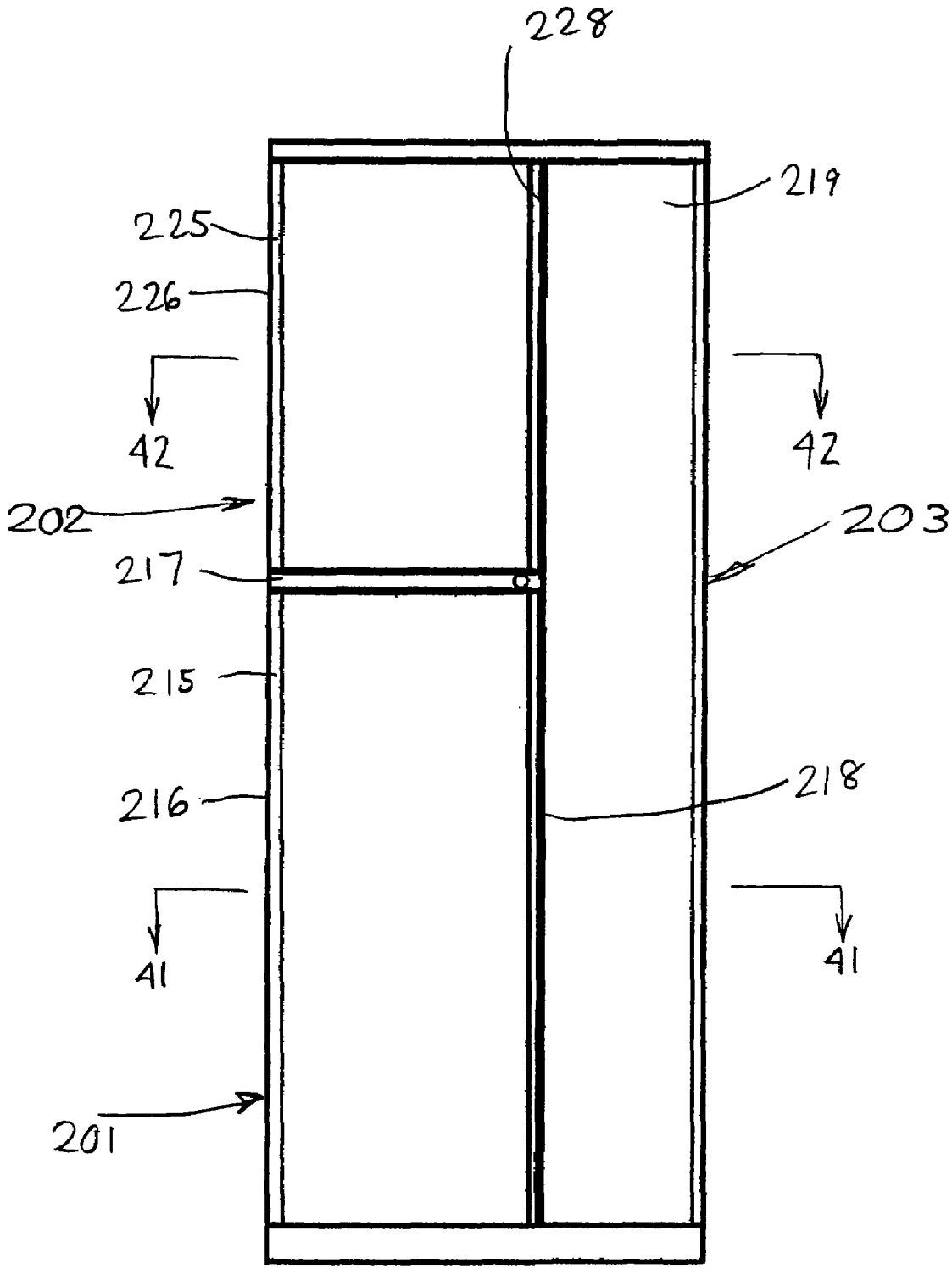
FIG. 35 is a front elevational thereof.

Referring to FIGS. 32 and 33, the pedestal section 201 includes a plurality of file drawers 204 which are supported by conventional drawer slides (not illustrated). The storage compartment 202 is generally open within the interior thereof and is closed off by a storage compartment door 205 which maybe opened by hand grip or pull 206. The wardrobe section extends the full height of the cabinet 200 and is closed off by a hinged wardrobe door 207 that also may be opened by a conventional hand grip or pull 208. Each of the doors 205 and 207 includes a respective lock assembly 209 or 210.

Generally, the storage cabinet 200 includes horizontal support structure, namely a top wall 212 and a bottom wall 213 which extend across the width of the cabinet 200 wherein the bottom wall 213 defines a rigid rectangular base. The top wall 212 and base 213 support a plurality of wall panels therebetween to define the upper storage module 202, the lower pedestal module 201 and the wardrobe section 203.

More particularly, the lower pedestal module 201 is formed substantially similar to the storage cabinets described above and in particular, is formed from an outer side wall 215 which defines an exterior face 216 of the cabinet. The outer side wall 215 extends upwardly and is rigidly connected to an intermediate top wall 217. Additionally, an inner side wall 218 is provided which has the same general rectangular shape as the outer side wall 215 but has a different configuration as described in further detail herein.

The entire cabinet 200 includes a single back wall 219 which encloses the entire back surface of the cabinet 200. The upper and lower ends of the side walls 215 and 218 therefore are rigidly connected to the intermediate top wall 217 and the base 213 to define a hollow housing unit. Further, a rectangular reinforcement insert 220 is fixed in the back of the pedestal compartment 221 so as to perform substantially the same function as the reinforcement boxes or inserts described above relative to the first and second embodiments. This lower pedestal module 201 therefore defines a rigid cubicle housing for rigidifying the entire storage cabinet 200.

The upper storage module 202 also has a somewhat similar construction. This upper module 202 includes an outer side wall 225 which defines the exterior face 226 (FIG. 32) of the cabinet 200. The upper module 202 further includes an inner side wall 228 which extends a partial height of the overall storage cabinet 200. The upper and lower ends of the side walls 225 and 228 are rigidly fastened to the respective top wall 212 and intermediate wall 217 while the vertical back edges of the side walls are disposed closely adjacent to the housing back wall 219.

Additionally, a further reinforcement insert 230 (FIG. 34) is provided to close off the back side of the storage module 202 and further rigidify the cabinet 200. It is noted that the inner side walls 218 and 228 thereby have interior faces 231 and 232 which define inside faces of the wardrobe compartment 233. The opposite side of the storage compartment 233 is closed off by an outer wardrobe side wall 234 which extends the full height of the cabinet 200 and is rigidly joined at the upper and lower edges respectively to the top wall 212 and the base 213 while the vertical rear edge of this sidewall 234 is rigidly affixed to the housing back wall 219. The side wall 234 defines an exterior face 235 of the cabinet.

Figure 36:
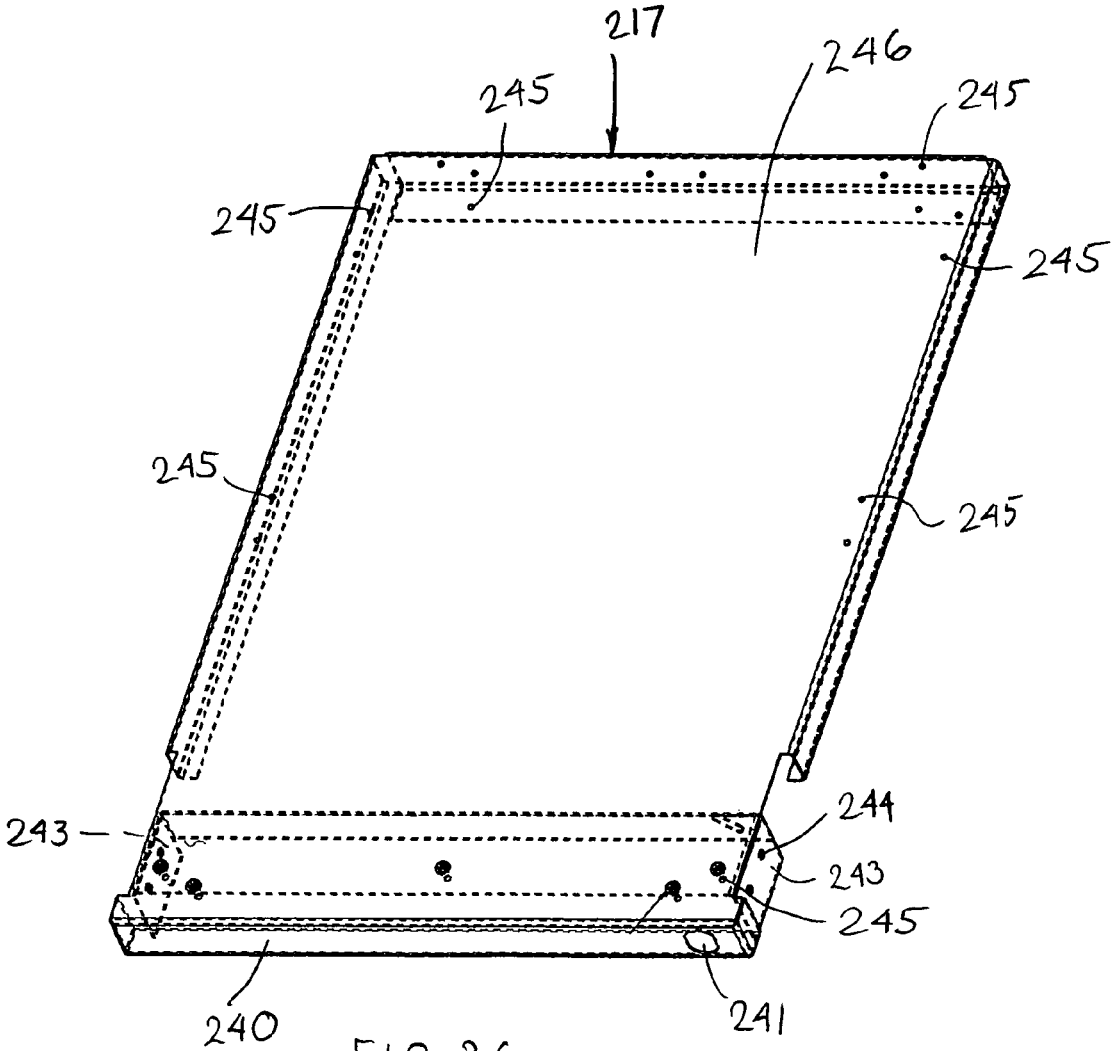
FIG. 36 is a top isometric view of a top panel for a lower housing box.

Referring to the intermediate top wall 217 of FIG. 36, this top wall includes a front trim section 240 which includes a lock port 241 (FIG. 36) which receives a lock 242 (FIG. 32). Additional edge flanges 243 are provided which includes fastener bores 244 which permit respective engagement with the side walls 215 and 218. Additional fastener bore 245 are provided therein for fastening the lower sidewalls 215 and 218 thereto as well as upper side walls 225 and 228. This intermediate wall 217 thereby has an upper surface 246 which defines the bottom of the storage compartment and also as a lower face which closes off the upper end of the pedestal module 201.

Figure 37:
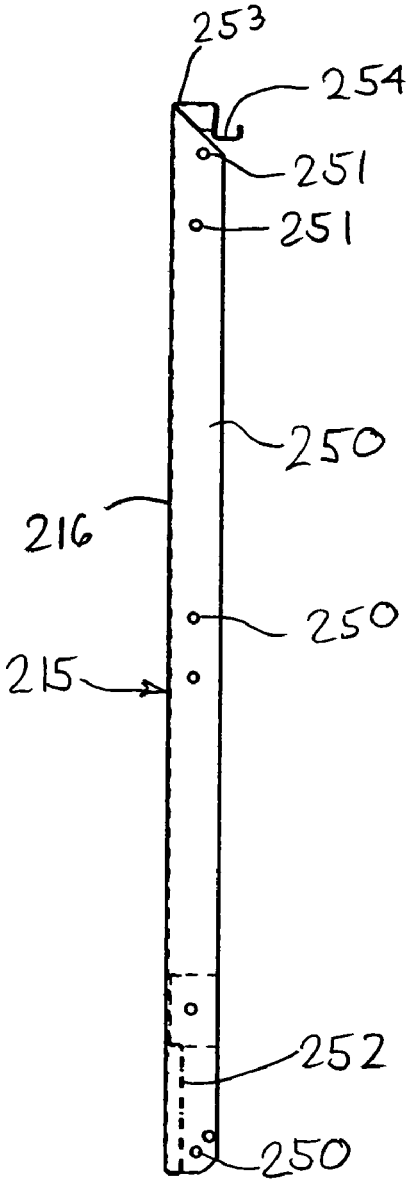
FIG. 37 is a plan view of an outer side wall for the lower box.

Referring to FIG. 37, the outer sidewall 215 is generally illustrated as having a major panel that defines the outside face 216 which terminates at the upper and lower horizontal edges with connector flanges 250. These flanges 250 each include arrangements of fastener bores 251 that align with the fastener bores 245 of the intermediate wall 217 and allow conventional screw fasteners to be inserted therethrough. The front edge of the sidewall 215 includes a reinforced edge portion 252 which is formed the same as the edge portions described above such that further discussion thereof is not necessary. This front edge portion 252 includes groups of openings like those described above that allow for the connection of the front end of drawer slide thereto.

At the back edge of the sidewall 215, an inturned flange 253 is provided which that shaped to define a J-shaped channel 254 which is adapted for fixed engagement with an adjacent edge of the backwall 219 as will be described in further detail hereinafter.

Figure 38:
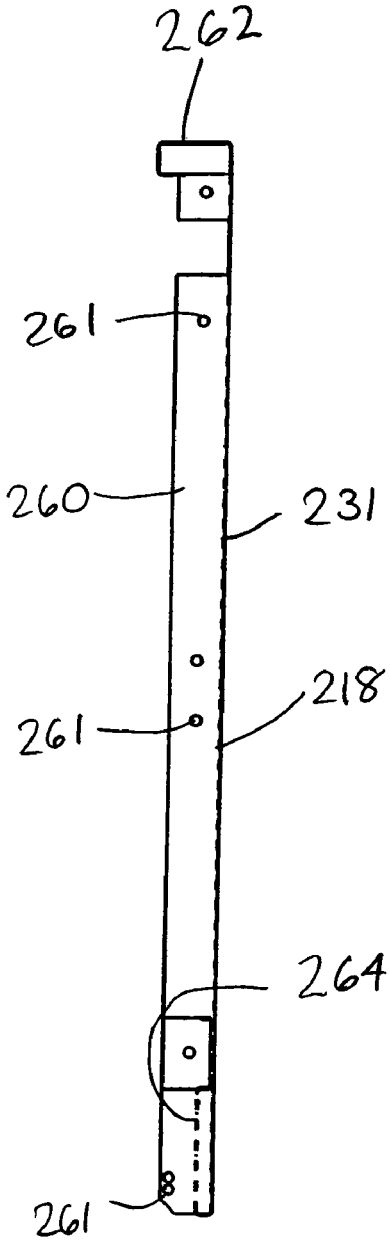
FIG. 38 is a plan view of an inner side wall for the lower box.

Referring to FIG. 38, the inner sidewall 218 is illustrated and has a major face that defines the interior wardrobe surface 231 wherein the upper and lower horizontal edges include connector flanges 260 and are provided with fastener bores 261 which align with the bores 245 of the wall 217 for engaging the upper edge of the sidewall 218 to the intermediate wall 217. The flanges 250 and 260 on the lower ends of the sidewalls 215 and 218 also include similar fastener holes and are fastened directly to the base 213 in a similar manner.

Figure 41:
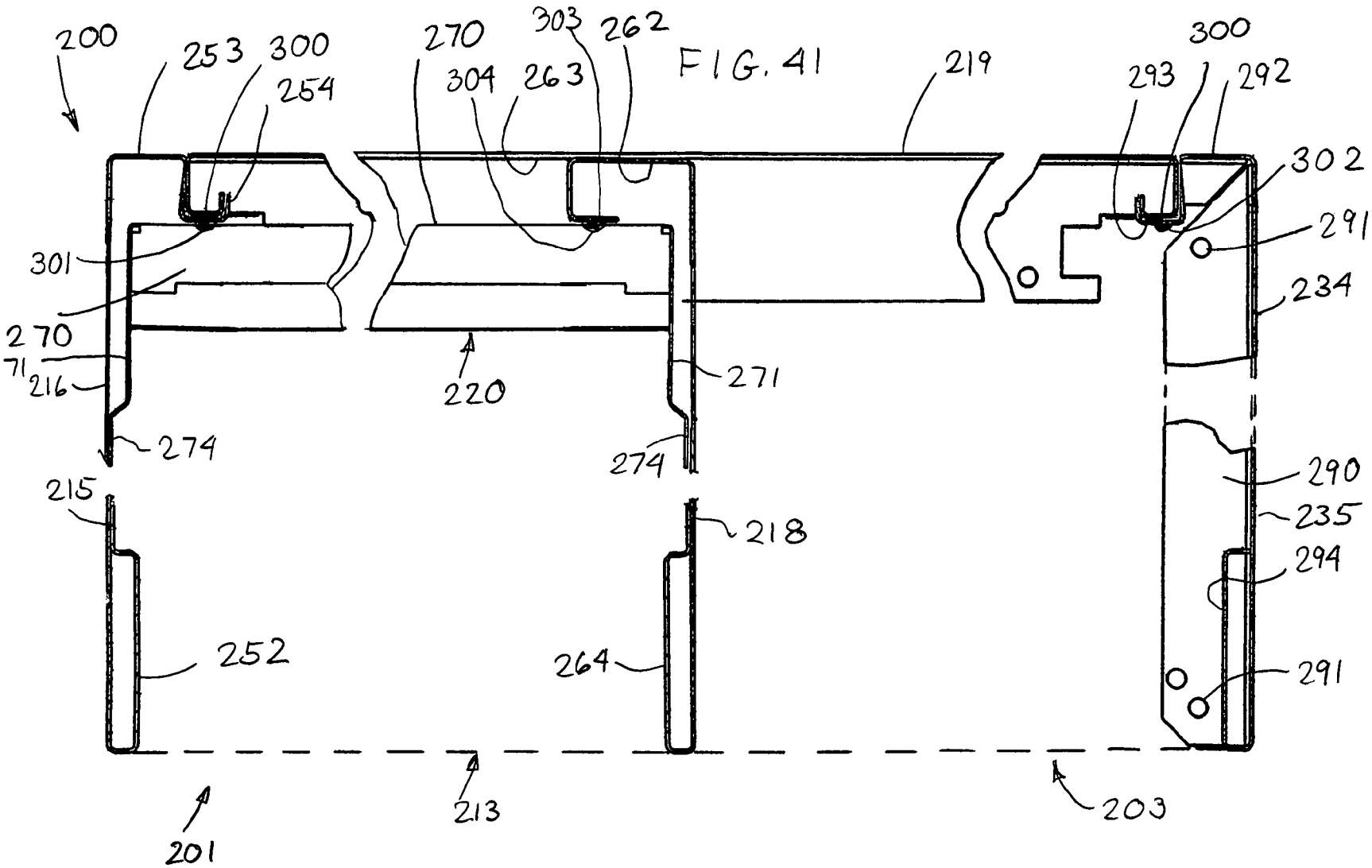
FIG. 41 is a top cross-sectional view of the housing wall components as taken along line 41-41 of FIG. 35.

The back edge of the sidewall 218 is inturned and shaped to define an abutment face 262 which faces rearwardly and is adapted to abut against the inside face 263 of the backwall 219 as discussed in further detail with respect to FIG. 41. The front edge of the sidewall 218 also includes the reinforced edge portion 264 which is formed as a mirror image relative to the reinforced edge portion 252 and also includes groups of openings to support the front end of conventional drawer slides.

The upper wall sections and in particular, the outer and inner walls 225 and 228 are formed substantially similar to the lower sidewalls 215 and 218 that are adapted to support storage shelves rather than drawers. Further discussion as to the sidewalls 225 and 228 is provided in the discussion relative to FIG. 42 below.

Figure 39:
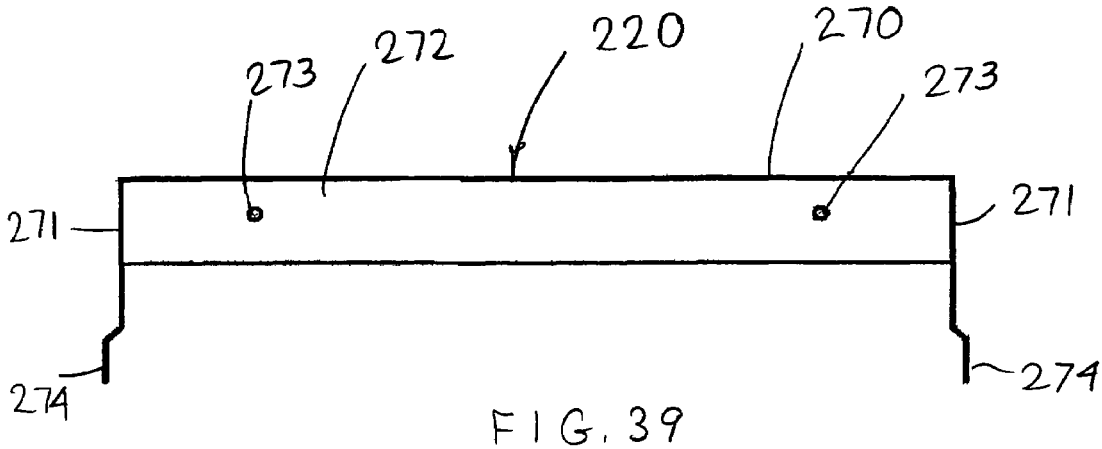
FIG. 39 is a plan view of a lower reinforcement box for the lower housing module.

FIG. 39 illustrates the lower reinforcement insert 220 which has a back panel 270 which faces rearwardly and has peripheral insert walls 271 (which extend vertically) and 272 (which extend horizontally) at the top and bottom thereof. The horizontal insert walls 272 include fastener bores 273. The vertical insert walls 271 also extend forwardly beyond the extent of the horizontal walls 272 and are stepped to define an end flange 274. This reinforcement insert 220 is structurally and functionally very similar to the reinforcement boxes described above.

Figure 40:
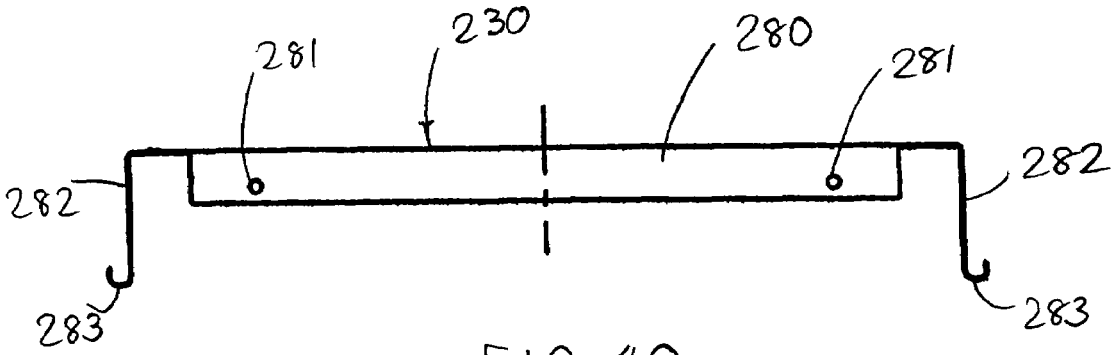
FIG. 40 is a plan view of an upper reinforcement box for the upper housing module.

The upper reinforcement insert 230 is illustrated in FIG. 40 and includes upper and lower horizontal walls 280 which include fastener bores 281 vertically therethrough. The reinforcement insert 230 further includes vertical insert walls 282 which extend forwardly beyond the extent of the horizontal walls 280 and terminate at an inturned or curled rib 283 to provide a finished appearance within the interior of the storage module 202.

Referring to the assembly of the above-described components, FIG. 41 is a top cross section illustrating the wall components through the lower pedestal module 201. The base 213 is illustrated in phantom outline and generally extends laterally between the outer side wall 215 and the wardrobe side wall 234. The base 213 extends rearwardly from the open front sides of the pedestal and wardrobe compartments up to the back edge of the cabinet 200, substantially flush with the back wall 219. Further discussion is not believed to be required other than the fact that the various side walls 215, 218 and 234 are rigidly fastened at their lower edges to the base 213. As can be seen, the rear side wall edge 253 defines the left rear corner of the cabinet housing.

The wardrobe side wall 234 includes a flange 290 at the upper and lower edges thereof which includes bores 291 to fasten the side wall 234 to the base 213. The back edge of the side wall 234 is inturned to define a right rear corner 292 of the cabinet and then has a J-shaped channel 293 for engagement with the adjacent edge of the back wall 219.

A front edge of the wardrobe side wall 234 also includes a reinforced edge portion 294 which is formed substantially similar to the edge portions 252 and 264. The wardrobe edge portion 294, however, includes appropriate slots to support shelves rather than drawer slides although the construction thereof also could be modified to accommodate such drawer slides if drawers were to be provided within the wardrobe compartment.

As to the back wall 219, this back wall 219 extends substantially the entire lateral width of the cabinet 200. Back wall 219 includes vertical edge flanges 300 which have a generally rectangular shape which fits tightly within the respective engagement channels 254 and 293 of the side walls 215 and 234 respectively. These sections are then fastened together by fasteners 301 and 302.

Abutment section 262 of the inner side wall 218 abuts against the interior face 263 of the back wall 219. Thereafter, the reinforcement insert 220 is fitted within the pedestal compartment in abutting engagement with the flange 254 as well as the end flange 303 of the inner side wall 218. The insert 220 is then fastened to these flanges by the fasteners 301 and additional fasteners 304. As a result, the reinforcement insert 220 has the back face 270 thereof spaced inwardly away from the back wall face 263 to define a hollow compartment and in effect define a rigid column for rigidifying the cabinet 200.

Figure 42:
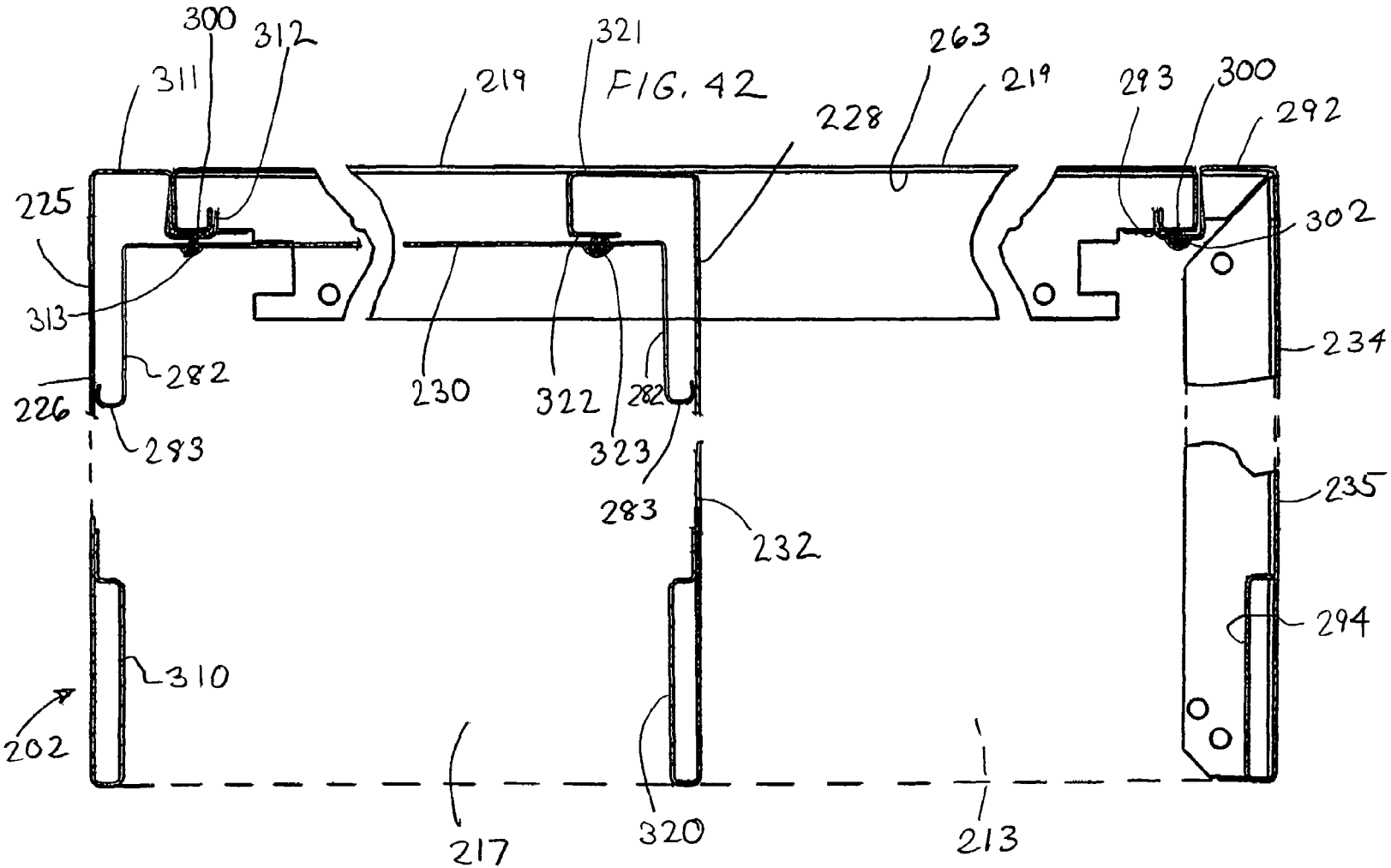
FIG. 42 is a top cross-sectional view of the wall components as taken along line 42-42 of FIG. 35.

Referring to FIG. 42, a substantially similar construction is provided for the upper storage area 202.

More particularly as to the upper storage module 202, this module 202 includes the upper outer side wall 225 mounted to the intermediate wall 217 which is diagrammatically illustrated in phantom outline. The outer wall 225 has a reinforced edge portion 310 at the front edge thereof which is formed similar to the edge portion 252 but is adapted for supporting a shelf thereon and therefore has appropriate slots for supporting a shelf rather than openings for supporting a drawer slide. The rear edge of the outer wall 225 includes an inturned section which defines a right rear corner 311 which then is shaped to define a J-shaped engagement channel 312 for receiving the respective edge section 300 of the back wall 319 therein. The edge section 300 and channel 312 are fastened together by fastener 313. The upper and lower edges of the outer wall 225 also include connector flanges which are fastened to the respective top wall 212 and intermediate wall 217.

With respect to the upper inner wall 228, this inner wall 228 is formed substantially similar to the lower inner wall 218. The wall 228 includes a reinforced front edge portion 320 which is formed as a mirror image of the reinforced edge portion 310 discussed above.

The vertical rear edge of the wall 228 further is inturned to define an abutment flange 321 which then defines a connector flange 322. The abutment flange 321 abuts against the inside face of the back wall 219 as can be seen.

The upper reinforcement insert 230 (FIG. 40) is also illustrated in FIG. 42 in a position adjacent the respective flanges on the side walls 225 and 228. The reinforcement insert 230 is then fastened in place by the fasteners 313 as well as additional fasteners 323. The curled edge portions 283 lie closely against the inside faces of the respective side walls 225 and 228 to provide a finished appearance to the storage compartment. Here again, the reinforcement insert 230 is spaced forwardly of the interior wall face 263 of the back wall 219 to effectively define a rigid column which reinforces the upper module and reinforces the entire cabinet housing 200.

This use of reinforced modules incorporates the inventive features of the above-described cabinets and allows the above-described cabinets to serve as a base module for the addition of further compartments in a multi-function cabinet 200.

Figure 43:
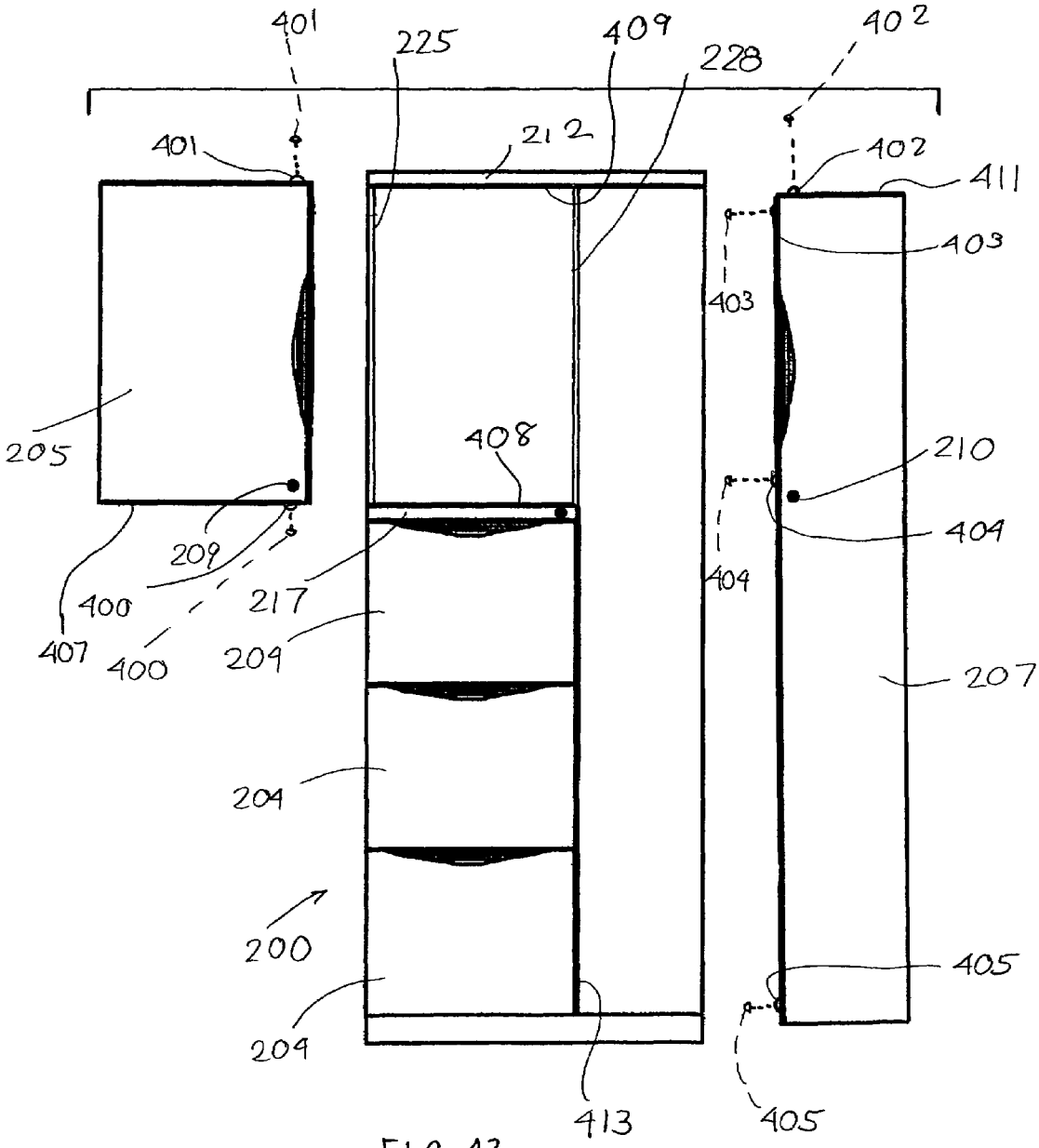
FIG. 43 is a front exploded view of the doors and spacer arrangement for the cabinet.

Referring to FIG. 43, the cabinet 200 further includes a spacer arrangement on the doors 205 and 207 to limit racking of the cabinet 200 when the doors are closed. In particular, the doors 205 and 207 are provided with a plurality of projecting spacers 400 through 405 which mount to the doors 205 or 207 and slidably abut against opposing surfaces to provide tight cooperating engagement between the cabinet components.

In particular, the door 205 is provided with two spacers 400 and 401 which are shown affixed to the door 205 as indicated by the solid reference line and in an exploded position prior to assembly as indicated by the dotted reference line. All of these spacers are defined by plastic or nylon buttons or nubs which have a convex outer surface and include a shank that snaps into a corresponding bore in the door edge 407. The spacer shank may be formed similar to a Christmas tree type fastener with the exposed nub portion of the spacer adapted for abutting contact with an adjacent surface of the cabinet.

As to bottom spacer 400, this spacer 400 projects downwardly and slidably abuts against the upward facing surface 408 of the middle panel wall 217. The other spacer 401 projects upwardly from the door edge 407 and slidably abuts against the downward facing surface 409 of the cabinet top 212. When the door 205 is closed, the spacers 400 and 401 wedge between the surfaces 408 and 409 so as to resist relative movement of the top wall 212 relative to the middle wall 217 and thereby rigidify the cabinet 200.

Similarly, the other door 207 has spacer 402 on the door edge 411 which projects upwardly and slidably abuts against the adjacent opposing cabinet surface 409 of the top wall 212. This further resists relative movement of the top wall 212 and racking of the cabinet 200.

The door 207 also includes two upper spacers 403 and 404 which project sidewardly into abutting engagement with the side door edge 407 of door 205 so as to resist movement of the doors 205 and 207. Still further, the door 207 has a bottom spacer 405 which projects sidewardly and abuts against the side edge 413 of the lower drawer 204. All of these spacers serve to resist racking or lateral distortion of the cabinet.

Still further, the spacers 400 through 405 project equal distances to define a uniform reveal line or gap between the doors 205 and 207, the drawers 204 and the cabinet walls 212 and 217. The spacers 400-405 thereby serve dual functions of rigidifying the cabinet 200 and improving the overall aesthetic appearance of the cabinet 200.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A file cabinet having a cabinet housing comprising:

a multi-sided housing unit comprising a back wall disposed between side walls in a U-shape which said back wall and said side walls are defined by a single continuous sheet of a rigid sheet material so as to be joined one with the other along corners thereof in a rear portion of said housing unit, said side walls being disposed in laterally spaced but opposing relation and have rear edge sections joined laterally together by said back wall wherein respective top and bottom edges of said back wall and said side walls define open top and bottom sides of said housing unit, said side walls further including front edge sections in a front portion of said housing unit which are laterally spaced apart to define an open front side of said cabinet housing which opens into a hollow interior of said cabinet housing wherein rigid horizontal support structure rigidly maintains said front edge sections in spaced relation, said housing unit further including a top wall which is positioned onto said top edges of said back wall and said side walls to enclose said open top side of said housing unit; and a reinforcement box comprising a planar back panel having a shape which corresponds to said back wall and interconnected edge panels, which said back wall and said edge panels are interconnected together so as to be movable together as a single integral unit that is positionable in said housing unit for reinforcing the rear portion of said housing unit, said edge panels extending about the periphery of said back panel and projecting forwardly therefrom to define front panel edges wherein said edge panels, including said front panel edges, are contained in the rear portion of said hollow interior, said edge panels being rigidly joined in end-to-end relation at corners defined therebetween and joined rigidly with said back panel about said periphery to define an open-sided box shape, said reinforcement box being positioned within said hollow interior and having an opposite pair of said edge panels which each extend vertically and are disposed in opposing contacting relation with an interior surface of a respective one of said side walls, said edge panels being immovably fastened directly to rear portions of said side walls along a vertical length thereof to fixedly and rigidly secure said side walls to said vertical edge panels of said reinforcement box and non-movably fix said rear portions of said side walls sidewardly relative to each other by said reinforcement box, said immovable fastening preventing displacement of said reinforcement box forwardly and rearwardly relative to said side walls and preventing said side walls from moving laterally outwardly away from said edge panels of said reinforcement box.

2. The file cabinet according to claim 1, wherein adjacent ends of said edge panels are rigidly affixed one to the other at the upper and lower corners of said reinforcement box to prevent relative displacement of said adjacent ends of said edge panels.

3. The file cabinet according to claim 1, wherein said reinforcement box is spaced forwardly of said back wall with a space being defined between opposing faces of said back wall and said back panel.

4. The file cabinet according to claim 3, wherein said space is bounded on four sides by said back panel and said back wall and rear portions of said side walls to define a tubular reinforcement column.

5. A storage cabinet comprising:

a foldable housing wrapper formed of a seamless continuous sheet of a rigid sheet material which said continuous sheet is folded into joined contiguous sections to define a back wall that is defined by one said section and is disposed between side walls that are defined by other said sections which said back wall and said side walls are joined one with the other by folding of said continuous sheet along a vertical length thereof along fold lines to define folded rear corners of said cabinet at said fold lines, said housing wrapper defining vertically open areas at the top and bottom of said housing wrapper which extend sidewardly between said side walls and forwardly from said back wall to a terminal open front side of said storage cabinet, said side walls being disposed in laterally spaced but opposing relation and have rear edge sections joined laterally together by said back wall, said side walls further including front edge sections which define front corners of said cabinet and are laterally spaced apart to define said open front side of said cabinet housing which opens into a hollow interior of said cabinet housing, said side walls further including integral reinforcing edge supports extending along a vertical front edge of each said side wall, each said edge support being formed integral with a front corner of the side wall by folding said sheet material with a plurality of bend lines into a tubular shape which has a multi-sided cross section when viewed from above, each said edge support having an interior wall spaced inwardly of the side wall;

at least one horizontal cross rail formed separate of said housing wrapper which is mountable to said side walls to extend across said open front side, said cross rail having opposite rail ends which are rigidly joined to respective upper or lower ends of said vertical edge supports wherein said cross rail is spaced forwardly of said back wall and said rear corners with one said vertically open area being disposed between said back wall and said cross rail, said horizontal cross rail having vertically depending mounting flanges which are offset inwardly of said rail ends and face sidewardly to abut against said interior side wall of said vertical edge support in opposing relation therewith, said mounting flange being rigidly fastened to said interior wall to define a rigid corner connection between said horizontal cross rail and said vertical edge support at said front corner with said front side being open adjacent said cross rail; and a top wall which is positioned onto said top edges of said back wall and said side walls to enclose said open top side of said housing unit.

6. The storage cabinet according to claim 5, wherein a second said horizontal cross rail is provided at the other of said upper or lower ends of said vertical edge support so as to be spaced forwardly of said back wall and said rear corners with a said vertically open area disposed therebetween wherein said mounting flanges thereof are rigidly affixed to said interior walls of said edge supports.

7. The storage cabinet according to claim 6, wherein said vertical edge supports have a rectangular configuration closed on four sides.

8. The storage cabinet according to claim 1, wherein each said front edge section has a front face which faces forwardly and defines an exposed front edge of said respective side wall.

9. A file cabinet comprising:

a multi-sided housing wrapper formed of a single seamless continuous sheet of a rigid sheet material which said continuous sheet is folded into joined contiguous sections to define a back wall and opposite side walls with said back wall extending laterally between said opposite side walls of said cabinet, said back wall and said side walls being joined together along vertical rear corners of said file cabinet by folding of said continuous sheet material wherein respective top and bottom edges of said back wall and said side walls respectively define open top and bottom sides of said housing wrapper, wherein said side walls extend forwardly and terminate at respective front edges which are laterally spaced apart to define an open front side of said file cabinet that opens into a hollow interior defined by said back wall and said side walls;

horizontal frame structure mountable to said housing wrapper and extending horizontally between said side walls, said frame structure being spaced forwardly away from said back wall with said hollow interior disposed therebetween, and being located proximate said front edges of said side walls to rigidly maintain said front edges in laterally spaced relation;

a reinforcement box formed separately of said housing wrapper as a single unit and rigidly affixed within said housing wrapper proximate said back wall, said reinforcement box having a back panel disposed in spaced, opposing relation with said back wall, said reinforcement box further including edge panels which project forwardly from the back panel so as to be contained in the rear portion of said hollow interior and are rigidly connected in end-to-end relation at corners defined between said edge panels, said edge panels having rear edges which are connected rigidly with adjacent side edges of said back panel to define an open-sided box shape for said reinforcement box, said reinforcement box having an opposite pair of said edge panels which extend vertically and are disposed in opposing relation with interior surfaces of said side walls and are immovably fastened to said side walls to prevent sideward displacement of said side walls laterally outwardly away from and inwardly toward each other in the region of said rear portion of said hollow interior said immovable fastening preventing displacement of said reinforcement box forwardly and rearwardly relative to said side walls and preventing said side walls from moving laterally outwardly away from said edge panels of said reinforcement box; and a top wall which is positioned onto said top edges of said back wall and said side walls to enclose said open top side of said housing unit.

10. The file cabinet according to claim 9, wherein said edge panels further define horizontal top and bottom panels, said housing wrapper including horizontally projecting flanges along upper and lower edges of said housing wrapper which are immovably fastened to said top and bottom panels of said reinforcement box.

11. The file cabinet according to claim 10, wherein said flanges are disposed on said side walls and said top and bottom panels are fixed to said flanges of said side walls.

12. The file cabinet according to claim 11, wherein said reinforcement box is spaced forwardly of said housing back wall and extends across the distance between inside faces of said side walls to define an interior space bounded on four sides by said back wall, said back panel and rear portions of said inside faces of said side walls.

13. The file cabinet according to claim 9, wherein said reinforcement box includes projections which project rearwardly to define the distance which said back panel is spaced forwardly of said back wall.

14. The file cabinet according to claim 9, wherein said reinforcement box includes upper and lower spacer flanges which project rearwardly into contact with said back wall and define the spacing which said back panel is spaced forwardly of said back wall.

15. The file cabinet according to claim 14, wherein said housing wrapper includes horizontally projecting wrapper flanges which project from upper and lower edges of said back wall, said wrapper flanges being affixed respectively to said upper and lower spacer flanges of said reinforcement box.

16. The file cabinet according to claim 9, wherein each of said edge panels of said reinforcement box that extend vertically has a front edge portion which is offset outwardly relative to a rear portion thereof, said front edge portion abutting against the inside surface of said side wall and being rigidly affixed thereto.

17. The file cabinet according to claim 16, wherein said front edge portion includes tabs which project rearwardly and are welded to said side walls.

18. The file cabinet according to claim 9, wherein said reinforcement box includes an interior space which opens forwardly and defines a rearward portion of said hollow interior of said cabinet housing.

19. The file cabinet according to claim 18, wherein said cabinet housing includes a plurality of drawers which are slidably supported on said side walls so as to be horizontally slidable from a closed position enclosed within said hollow interior and an open position projecting forwardly from said open front side, a rear portion of said drawers being received within said hollow box interior when said drawer is in said closed position with a front portion of said drawers projecting forwardly out of said hollow box interior.

20. A file cabinet comprising:

a cabinet housing defined by vertical side walls, a vertical back wall extending laterally between rear edges of said side walls to define a hollow interior of said cabinet housing, which said side walls and said back wall define open top, bottom and front sides, and a separate top wall which is mounted to said side walls and back wall and encloses said top side of said housing when mounted on said side walls and said back wall, front edges of said side walls defining said open front side of said cabinet wherein a plurality of drawers are slidably supported on said side walls by horizontally extending drawer slides, said cabinet housing comprising a single continuous sheet of a rigid sheet material which defines said back wall and said side walls and rigid rear corners of said cabinet housing disposed between said back wall and said side walls; and a shallow reinforcement box formed separate of said cabinet housing for installation as a single integral unit in said hollow interior adjacent said back wall, said reinforcement box having a back panel which encloses a back side of said reinforcement box and a plurality of edge panels which define peripheral sides thereof and terminate at front panel edges, said edge panels defining an open front side of said box which faces forwardly to define a rearward portion of said hollow interior of said cabinet housing, said reinforcement box being spaced forwardly of an inside face of said back wall and said edge panels being immovably fastened directly to said side walls of said cabinet housing after installation to rigidly support said side walls in immovably fixed, laterally spaced relation wherein interior surfaces of said back wall, said back panel and rear portions of said side walls define a rigid tubular column, and said drawers having rear end portions which extend adjacent to said front panel edges of said reinforcement box when in said stored position enclosed within said cabinet housing.

21. The file cabinet according to claim 20, wherein said front edges of said side walls are shaped to define reinforcing edge supports which are formed integral with said side walls from the rigid sheet material of said side walls.

22. The file cabinet according to claim 21, wherein said drawer slides are supported on their opposite ends on said edge supports and said reinforcement box in vertically spaced relation.

23. The file cabinet according to claim 22, wherein horizontal support rails are formed separate from said cabinet housing and are provided having opposite ends which are rigidly affixed to said reinforcing edge supports to maintain said front edges of said side walls in laterally spaced relation.

24. The storage cabinet according to claim 5 which further comprises said top wall formed separate of said cross rail and mountable to said housing wrapper, said cross rail being disposed below said top wall and defining said rigid corner connections at said front corners.

25. The storage cabinet according to claim 6, which further comprises said top wall formed separate of said cross rail and enclosing said open top area of said housing wrapper, said cross rails both being disposed below said top wall and respectively defining said rigid corner connections at said front corners.

26. A storage cabinet comprising:

a foldable housing wrapper formed of a single folded sheet of a rigid sheet material which is folded into joined contiguous sections to define a back wall disposed between side walls which said back wall and said side walls are joined one with the other by folding of said rigid sheet material along a vertical length thereof along fold lines to define folded rear corners of said cabinet at said fold lines, said housing wrapper having a U-shape defining vertically open areas at the top and bottom of said housing wrapper, said side walls being disposed in laterally spaced but opposing relation and have rear edge sections joined laterally together by said back wall, said side walls further including front edge sections which define front corners of said cabinet and are laterally spaced apart to define an open front side of said cabinet housing which opens into a hollow interior of said cabinet housing, said side walls further including integral reinforcing edge supports extending along a vertical front edge of each said side wall, each said edge support being formed integral with a front corner of the side wall by folding said sheet material with a plurality of bend lines into a tubular shape which has a multi-sided cross section when viewed from above, each said edge support having an interior wall spaced inwardly of the side wall and upper and lower ends respectively defining vertically-facing end faces;

at least one horizontal cross rail formed separate of said housing wrapper which is mountable to said side walls to extend across said open front side, said cross rail having opposite rail ends which are rigidly joined to respective upper or lower ends of said vertical edge supports wherein said cross rail is spaced forwardly of said back wall and said rear corners with one said vertically open area being disposed between said back wall and said cross rail, said horizontal cross rail having vertically depending mounting flanges which are offset inwardly of said rail ends and face sidewardly to abut against said interior side wall of said vertical edge support in opposing relation therewith and having projections which project sidewardly beyond said mounting flanges adjacent said end faces of said edge supports to locate said cross rail on said end faces of said edge supports, said mounting flange being rigidly affixed to said interior wall to define a rigid corner connection between said horizontal cross rail and said vertical edge support at said front corner with said front side being open adjacent said cross rail, said cross rail and said wrapper forming a sub-assembly; and a top wall formed separately of said cross rail and mounted to said sub-assembly to enclose said top open area.

27. The storage cabinet according to claim 26, wherein a second said horizontal cross rail is provided at the other of said upper or lower ends of said vertical edge support so as to be spaced forwardly of said back wall and said rear corners with a said vertically open area disposed therebetween wherein said mounting flanges thereof are rigidly affixed to said interior walls of said edge supports.

28. The storage cabinet according to claim 27, wherein said projections overlie said vertically-facing end faces of said vertical edge supports.

29. The storage cabinet according to claim 27, wherein each said vertical edge support is folded to define a terminal side portion which includes a fixing flange affixed respectively to said inside face of said side wall.

30. The storage cabinet according to claim 29, wherein said fixing flange is welded to said inside face of said side wall respectively.

31. The storage cabinet according to claim 5, wherein said top wall is formed separate from said cross rail and said housing wrapper, said housing wrapper and said cross rail being rigidly joined in a sub-assembly and said top wall being mounted to said sub-assembly to enclose said open area at the top of said housing wrapper.

* * * * *